US011829104B2

(12) United States Patent
Mizuguchi et al.

(10) Patent No.: US 11,829,104 B2
(45) Date of Patent: Nov. 28, 2023

(54) TONER

(71) Applicant: CANON KABUSHIKI KAISHA, Tokyo (JP)

(72) Inventors: Takuya Mizuguchi, Shizuoka (JP); Yoshitaka Suzumura, Shizuoka (JP); Hiroyuki Tomono, Shizuoka (JP); Osamu Matsushita, Kanagawa (JP); Shotaro Nomura, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 221 days.

(21) Appl. No.: 17/241,330

(22) Filed: Apr. 27, 2021

(65) Prior Publication Data

US 2021/0356878 A1 Nov. 18, 2021

(30) Foreign Application Priority Data

May 18, 2020 (JP) ..... 2020-086600

(51) Int. Cl.
*G03G 9/087* (2006.01)

(52) U.S. Cl.
CPC ..... *G03G 9/08755* (2013.01); *G03G 9/08746* (2013.01); *G03G 9/08759* (2013.01)

(58) Field of Classification Search
CPC ..... G03G 9/08788; G03G 9/08755; G03G 9/08711
See application file for complete search history.

(56) References Cited

U.S. PATENT DOCUMENTS

| | | | |
|---|---|---|---|
| 7,811,734 | B2 | 10/2010 | Ogawa et al. |
| 8,227,162 | B2 | 7/2012 | Sano et al. |
| 8,426,094 | B2 | 4/2013 | Magome et al. |
| 8,614,044 | B2 | 12/2013 | Matsui et al. |
| 8,778,585 | B2 | 7/2014 | Matsui et al. |
| 8,883,389 | B2 | 11/2014 | Matsui et al. |
| 8,918,035 | B2 | 12/2014 | Hasegawa et al. |
| 9,029,055 | B2 | 5/2015 | Aoki et al. |
| 9,097,997 | B2 | 8/2015 | Nomura et al. |

(Continued)

FOREIGN PATENT DOCUMENTS

| | | | | |
|---|---|---|---|---|
| JP | 2006251564 A | * | 9/2006 | ..... G03G 9/0806 |
| JP | 2016-90628 A | | 5/2016 | |

OTHER PUBLICATIONS

JP 2006251564 A translation (Year: 2023).*

*Primary Examiner* — Peter L Vajda
(74) *Attorney, Agent, or Firm* — VENABLE LLP

(57) ABSTRACT

A toner comprising a toner particle comprising a binder resin and a crystalline resin, wherein the binder resin comprises an amorphous resin, when the toner is measured with a temperature-modulated differential scanning calorimeter, at least one endothermic peak derived from the crystalline resin is present in a temperature range from 55.0° C. to 95.0° C. in a total heat flow; and a ratio of an endothermic quantity of the endothermic peak in a reversing heat flow to an endothermic quantity of the endothermic peak in the total heat flow is 50.0% or more, a glass transition temperature Tg1st obtained in the reversing heat flow in a first temperature rise and a glass transition temperature Tg2nd obtained in a reversing heat flow in a second temperature rise satisfy Tg1st−Tg2nd≥7.0° C.

9 Claims, 1 Drawing Sheet

(56) References Cited

U.S. PATENT DOCUMENTS

| | | | |
|---|---|---|---|
| 9,201,323 | B2 | 12/2015 | Nishikawa et al. |
| 9,213,250 | B2 | 12/2015 | Nomura et al. |
| 9,217,943 | B2 | 12/2015 | Matsui et al. |
| 9,239,528 | B2 | 1/2016 | Hasegawa et al. |
| 9,244,371 | B2 | 1/2016 | Suzumura et al. |
| 9,250,548 | B2 | 2/2016 | Nomura et al. |
| 9,261,804 | B2 | 2/2016 | Yamazaki et al. |
| 9,341,970 | B2 | 5/2016 | Yoshiba et al. |
| 9,417,542 | B2 | 8/2016 | Hiroko et al. |
| 9,470,993 | B2 | 10/2016 | Nishikawa et al. |
| 9,588,450 | B2 | 3/2017 | Tsuda et al. |
| 9,606,462 | B2 | 3/2017 | Nomura et al. |
| 9,625,841 | B2 | 4/2017 | Hiroko et al. |
| 9,804,514 | B2 | 10/2017 | Suzumura et al. |
| 9,804,519 | B2 | 10/2017 | Suzumura et al. |
| 9,829,818 | B2 | 11/2017 | Yoshiba et al. |
| 9,841,692 | B2 | 12/2017 | Hasegawa et al. |
| 9,897,932 | B2 | 2/2018 | Hotta et al. |
| 9,927,728 | B2 | 3/2018 | Arimura et al. |
| 9,946,179 | B2 | 4/2018 | Arimura et al. |
| 9,946,181 | B2 | 4/2018 | Hasegawa et al. |
| 9,964,874 | B2 | 5/2018 | Suzumura et al. |
| 9,964,881 | B2 | 5/2018 | Ikejiri et al. |
| 9,971,262 | B2 | 5/2018 | Hasegawa et al. |
| 9,971,263 | B2 | 5/2018 | Fukudome et al. |
| 9,971,264 | B2 | 5/2018 | Sano et al. |
| 10,012,923 | B2 | 7/2018 | Sano et al. |
| 10,101,683 | B2 | 10/2018 | Nishikawa et al. |
| 10,197,934 | B2 | 2/2019 | Matsui et al. |
| 10,228,627 | B2 | 3/2019 | Nagashima et al. |
| 10,228,630 | B2 | 3/2019 | Mizuguchi et al. |
| 10,241,430 | B2 | 3/2019 | Kimura et al. |
| 10,289,016 | B2 | 5/2019 | Fukudome et al. |
| 10,295,921 | B2 | 5/2019 | Ohmori et al. |
| 10,310,397 | B2 | 6/2019 | Sano et al. |
| 10,545,420 | B2 | 1/2020 | Kinumatsu et al. |
| 10,698,327 | B2 | 6/2020 | Nagashima et al. |
| 10,942,463 | B2 | 3/2021 | Yoshiba et al. |
| 10,983,450 | B2 | 4/2021 | Nomura et al. |
| 10,983,451 | B2 | 4/2021 | Hashimoto et al. |
| 10,996,577 | B2 | 5/2021 | Nishikawa et al. |
| 2009/0197192 | A1 | 8/2009 | Hiroko et al. |
| 2015/0037729 | A1* | 2/2015 | Yoshiba ..... G03G 9/0808 430/109.4 |
| 2016/0161874 | A1 | 6/2016 | Yamazaki et al. |
| 2016/0378003 | A1 | 12/2016 | Arimura et al. |
| 2020/0209768 | A1 | 7/2020 | Furui et al. |
| 2020/0285164 | A1 | 9/2020 | Akiyama et al. |
| 2021/0080846 | A1 | 3/2021 | Mizuguchi et al. |

* cited by examiner

TONER

BACKGROUND OF THE INVENTION

Field of the Invention

The present disclosure relates to a toner used in an image forming method for developing an electrophotographic image or an electrostatic charge image.

Description of the Related Art

Energy saving and speeding up are in high demand for image forming apparatuses that use electrophotography, hence low-temperature fixability of toners needs to be improved. Generally, low-temperature fixability depends on the viscosity of toners, and toners having a viscosity that rapidly decrease under the effect of heat during fixing are needed. However, toners satisfying such low-temperature fixability are unlikely to withstand external stress resulting from agitation in a developing device and temperature rise of a main body, and problems such as decrease in durability and decrease in storage stability caused by embedding of an external additive can easily occur.

Japanese Patent Application Publication No. 2016-090628 describes a toner in which a crystalline polyester having carbon atoms in a specific range is added to an amorphous polyester to improve low-temperature fixability, development stability, and print storage property.

SUMMARY OF THE INVENTION

However, although the toner to which the crystalline polyester having carbon atoms in a specific range is added as described in the above document has a certain effect on the low-temperature fixability, it has been found that in a higher speed image forming apparatus, the toner is fused with a regulating member and development streaks are generated. The present disclosure provides a toner that has, even in a high-speed machine, favorable low-temperature fixability and can suppress image streaks.

As a result of repeated studies, the present inventors have found that the above problems can be solved by adopting the following configuration.

The present disclosure relates to a toner comprising a toner particle comprising a binder resin and a crystalline resin, wherein the binder resin comprises an amorphous resin, when the toner is measured with a temperature-modulated differential scanning calorimeter, at least one endothermic peak derived from the crystalline resin is present in a temperature range from 55.0° C. to 95.0° C. in a total heat flow; and a ratio of an endothermic quantity of the endothermic peak in a reversing heat flow to an endothermic quantity of the endothermic peak in the total heat flow is 50.0% or more, a glass transition temperature Tg1st obtained in the reversing heat flow in a first temperature rise and a glass transition temperature Tg2nd obtained in a reversing heat flow in a second temperature rise satisfy $$Tg1st-Tg2nd \geq 7.0^\circ \text{ C.}$$

The present disclosure can provide a toner that has, even in a high-speed machine, favorable low-temperature fixability and can suppress image streaks. Further features of the present invention will become apparent from the following description of exemplary embodiments with reference to the attached drawings.

DESCRIPTION OF THE EMBODIMENTS

Figures 1A, 1B:
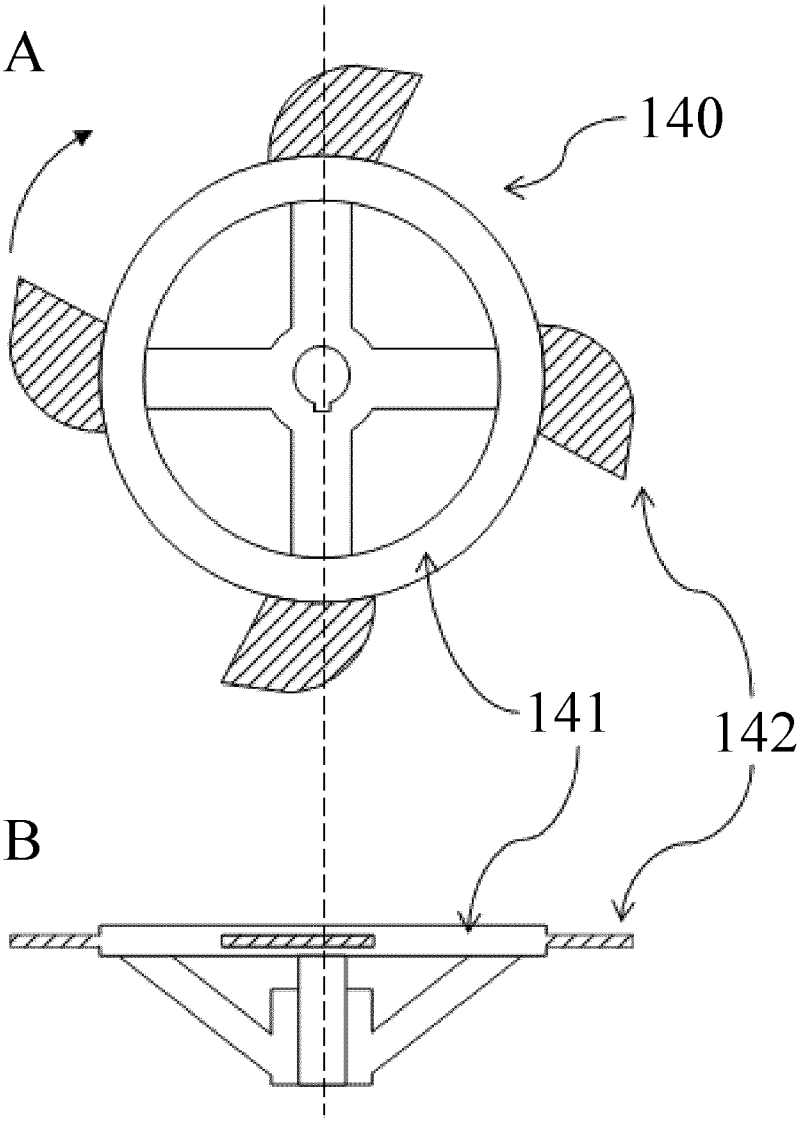
FIGS. 1A and 1B are examples of a processing blade.

Unless otherwise specified, the description of "from XX to YY" or "XX to YY" indicating a numerical range means a numerical range including a lower limit and an upper limit which are endpoints. When a numerical range is described in stages, the upper and lower limits of each numerical range can be combined arbitrarily. The "monomer unit" refers to the reacted form of a monomer substance in a polymer.

In order to improve the low-temperature fixability, it is necessary to melt the toner rapidly in a short time after the tonner passed through the fixing nip. Controlling melting characteristics of the resin component in the toner is generally known as a method for rapidly melting the toner. In recent years, various methods have been studied in which a crystalline resin is used as a fixing aid and melting characteristics of the resin component are controlled by a plasticizing effect.

Accordingly, in order to achieve a high level of low-temperature fixability required in recent years, a toner to which a large amount of crystalline polyester resin was added was evaluated. As a result, it was found that although there is a certain effect on the low-temperature fixability, image streaks occur under high-speed printing conditions assumed for printers of the next generation. Therefore, in response to future demands for energy saving and high speed, it is necessary to study a toner that is unlikely to fuse with a regulating member and that can suppress image streaks even if a large amount of crystalline resin is added.

As a result of studies conducted to solve the trade-off items of improving low-temperature fixability and suppressing image streaks, the present inventors came up with an idea that the above problems could be solved by using a toner having the following characteristics.

That is, the present disclosure relates to a toner comprising a toner particle comprising a binder resin and a crystalline resin, wherein the binder resin comprises an amorphous resin, when the toner is measured with a temperature-modulated differential scanning calorimeter, at least one endothermic peak derived from the crystalline resin is present in a temperature range from 55.0° C. to 95.0° C. in a total heat flow; and a ratio of an endothermic quantity of the endothermic peak in a reversing heat flow to an endothermic quantity of the endothermic peak in the total heat flow is 50.0% or more, a glass transition temperature Tg1st obtained in the reversing heat flow in a first temperature rise and a glass transition temperature Tg2nd obtained in a reversing heat flow in a second temperature rise satisfy $$Tg1st-Tg2nd \geq 7.0^\circ \text{ C.}$$

The toner will be specifically described hereinbelow. It is required that where the toner is measured with a temperature-modulated differential scanning calorimeter (MDSC), at least one endothermic peak derived from the crystalline resin is present in a temperature range of from 55.0° C. to 95.0° C. in a total heat flow; and the ratio of an endothermic quantity of an endothermic peak in a reversing heat flow to an endothermic quantity of the endothermic peak in the total heat flow is 50.0% or more.

The ratio of an endothermic quantity of an endothermic peak in a reversing heat flow to an endothermic quantity of the endothermic peak in the total heat flow is preferably 60.0% or more, more preferably 70.0% or more, and even more preferably 80.0% or more because a good image streak suppression effect can be obtained. The upper limit is not particularly limited, but 95.0% or less is preferable, and 90.0% or less is more preferable.

By configuring the toner as described above, image streaks can be suppressed even when printing at high speed. The reason is considered hereinbelow. A crystalline resin typified by a crystalline polyester resin generally has a larger molecular weight than a low melting point wax or the like, and once melted, a large amount of energy is required for recrystallization thereof. The crystalline resin that could not be completely recrystallized in the toner (the crystal structure is disturbed) is compatible with the amorphous resin in the toner and causes a decrease in the glass transition temperature (Tg) of the toner, thereby reducing durability and heat-resistant storage stability. Further, under high-speed printing conditions, the stress caused by stirring and raising the temperature is large around the regulating member, and the environment is harsh for the toner, so that the recrystallized crystal structure is likely to be disturbed. Therefore, in order to suppress the fusion of the toner with the member and prevent image streaks even under high-speed printing conditions, it is important to control the crystal structure of the crystalline resin to a highly stable crystal structure that is unlikely to be disturbed.

The present inventors confirmed and examined the crystal structure of the crystalline resin in the toner by using a temperature-modulated differential scanning calorimeter (MDSC). The measurement by the temperature-modulated differential scanning calorimeter is a differential scanning calorimetry method in which a calorific value is measured when the temperature is raised by superimposing the temperature rise/fall (modulation waveform) of a constant frequency on a normal temperature rise. By further applying temperature modulation at the same time as raising the temperature at a constant speed, it is possible to detect a component that can follow the temperature modulation and a component that cannot follow the temperature modulation separately for a reversing heat flow and a non-reversing heat flow, respectively. The component appearing in the reversing heat flow returns to the original properties when the temperature is lowered, but the component appearing in the non-reversing heat flow does not return to the original properties even when the temperature is lowered.

When the crystal structure of the crystalline resin in the toner is stable, even if the crystal structure collapses due to temperature rise, the crystal structure easily returns to the original state when the temperature drops, and therefore, the ratio of the endothermic peak derived from the melting of the crystalline resin increases in the reversing heat flow. Meanwhile, where the crystal structure of the crystalline resin in the toner is unstable, once the crystal structure collapses due to the temperature rise, it is difficult to return to the original crystal structure even when the temperature is lowered, and therefore, the ratio of the endothermic peak derived from the melting of the crystalline resin increases in the non-reversing heat flow.

Where the ratio of the endothermic quantity of the endothermic peak in the reversing heat flow to the endothermic quantity of the endothermic peak in the total heat flow is less than 50.0%, the crystal structure of the crystalline resin is likely to collapse due to stress in the developing device, and therefore, image streaks occur. The ratio of the endothermic quantities can be controlled, for example, by adjusting the composition of resin components in the toner, the composition of the crystalline resin, and also the production conditions of the toner.

Further, when the toner is measured by a temperature-modulated differential scanning calorimeter (MDSC), the glass transition temperature Tg1st obtained in the reversing heat flow in the first temperature rise and the glass transition temperature Tg2nd obtained in the reversing heat flow in the second temperature rise need to satisfy:

$$Tg1st-Tg2nd \geq 7.0^\circ \text{ C.}$$

Further, from the viewpoint of good low-temperature fixability, Tg1st−Tg2nd is preferably 10.0° C. or higher, and more preferably 15.0° C. or higher. The upper limit is not particularly limited, but is preferably 25.0° C. or lower, more preferably 20.0° C. or lower, and further preferably 17.0° C. or lower.

Tg1st is obtained by measuring the glass transition temperature Tg of the toner before heating, and since the crystalline resin is not melted, it represents the toner Tg before the crystalline resin is made compatible with the amorphous resin. Meanwhile, since Tg2nd is obtained by measuring Tg after the toner Tg has been heated and the crystalline resin has been melted, it represents the toner Tg after the crystalline resin has been made compatible with the amorphous resin. In other words, it is considered that the larger the difference between Tg1st and Tg2nd, the greater the plasticizing effect of the amorphous resin by the crystalline resin. Therefore, when the difference between Tg1st and Tg2nd is large, it can be said that the toner has more excellent low-temperature fixability.

When the value of Tg1st−Tg2nd is smaller than 7.0° C., the compatibility of the crystalline resin with the amorphous resin is lowered, so that the low temperature fixability is lowered. The value of Tg1st−Tg2nd can be controlled by, for example, adjusting the composition of resin components in the toner, the composition of a fixing aid, and the combination or dispersion state of the resin component and the fixing aid. In addition, this value can be controlled by adjusting the toner production conditions. Tg1st is preferably from 50.0° C. to 70.0° C., and more preferably from 55.0° C. to 65.0° C., and Tg2nd is preferably from 38.0° C. to 55.0° C., and more preferably from 40.0° C. to 50.0° C.

Binder Resin

Hereinafter, the binder resin will be specifically described. The binder resin is not particularly limited, and a known resin can be used. The binder resin comprises an amorphous resin. The binder resin preferably comprises an amorphous polyester resin, and more preferably is an amorphous polyester resin. The amorphous polyester resin has an amorphous polyester segment. The amount of the amorphous polyester resin in the binder resin is preferably from 50% by mass to 100% by mass, more preferably from 80% by mass to 100% by mass, and further preferably from 90% by mass to 100% by mass.

The amorphous polyester resin preferably includes a hybrid resin having a vinyl polymer segment and an amorphous polyester segment. Where the binder resin includes a hybrid resin having an amorphous polyester segment having excellent melting properties and a vinyl polymer segment having excellent charging characteristic and a high softening point, excellent charging stability and low-temperature fixability are achieved while increasing the softening point of the binder resin. As a result, the low-temperature fixability and the stability of image density under a high-humidity environment are further enhanced.

Further, the amorphous polyester resin is more preferably an amorphous polyester resin composition. The amorphous polyester resin composition preferably includes a hybrid resin having a vinyl polymer segment and an amorphous polyester segment.

The amorphous polyester resin composition preferably comprises i) at least one of a structure in which a long-chain alkyl monoalcohol having an average number of carbon atoms of from 27 to 50 is condensed at the end of an amorphous polyester segment, and a structure in which a long-chain alkyl monocarboxylic acid having an average number of carbon atoms of from 27 to 50 is condensed at the end of the amorphous polyester segment, and ii) an aliphatic hydrocarbon with an average number of carbon atoms of from 27 to 50.

Where the binder resin includes the above resin composition, when the crystalline polyester resin is added, the crystallization rate of the crystalline polyester resin is improved, and a toner having good heat storage stability can be obtained. Further, the ratio of the endothermic quantity of the endothermic peak in the reversing heat flow to the endothermic quantity in the total heat flow can be easily controlled within the above specific range.

The structure in which a long-chain alkyl monoalcohol is condensed will be hereinbelow also referred to as an alcohol residue. The structure in which a long-chain alkyl monocarboxylic acid is condensed will be hereinbelow also referred to as a carboxylic acid residue. Moreover, these residues are also called long-chain alkyl components.

Here, a polyester resin having at least one residue of the alcohol residue of a long-chain alkyl monoalcohol and the carboxylic acid residue of a long-chain alkyl monocarboxylic acid as a terminal represents a resin in which these long-chain alkyl components have been incorporated by reacting with an amorphous polyester resin (amorphous polyester segment) that is the main binder component.

Meanwhile, where the amorphous polyester resin composition includes the aliphatic hydrocarbon having the above average carbon number, the amorphous polyester resin composition also includes an unmodified component, for example, when a long-chain alkyl component has been alcohol-modified or acid-modified. The amorphous polyester resin composition means that it comprises a polyester resin in which a long-chain alkyl component is incorporated and an aliphatic hydrocarbon component (which is, for example, an unmodified product of the long-chain alkyl component).

The average value of a carbon number of a long-chain alkyl component is determined by the following method. The distribution of the carbon number in the long-chain alkyl component is measured as follows by gas chromatography (GC). 10 mg of the sample is exactly weighed out and introduced into a sample vial. 10 g of exactly weighed hexane is added to this sample vial and the lid is put on followed by heating to a temperature of 150° C. on a hot plate and mixing.

After this, and in a state in which the long-chain alkyl component has not precipitated, this sample is injected into the injection port of a gas chromatograph and analysis is performed by the following measurement instrumentation and measurement conditions to obtain a chart in which the horizontal axis is the carbon number and the vertical axis is the signal strength. Then, using the obtained chart, the percentage for the peak area for the component at each carbon number is calculated with respect to the total area of all the detected peaks and this is taken to be the percentage occurrence (area %) for the individual hydrocarbon compounds. A carbon number distribution chart is constructed plotting the carbon number on the horizontal axis and the percentage occurrence (area %) of the hydrocarbon compounds on the vertical axis. The average carbon number refers to the carbon number for the peak top in the chart for the distribution of the carbon number.

The measurement instrumentation and measurement conditions are as follows.

GC: 6890GC from Hewlett-Packard
column: ULTRA ALLOY-1 P/N: UA1-30m-0.5F (from Frontier Laboratories Ltd.)
carrier gas: He
oven: (1) hold 5 minutes at a temperature of 100° C., (2) ramp up to a temperature of 360° C. at 30° C./minute, (3) hold for 60 minutes at a temperature of 360° C.
injection port: temperature=300° C.
initial pressure: 10.523 psi
split ratio: 50:1
column flow rate: 1 mL/min Further, the total content ratio of an aliphatic hydrocarbon having an average value of a carbon number of from 27 to 50, the structure (alcohol residue) in which a long-chain alkyl monoalcohol having an average value of a carbon number of from 27 to 50 are condensed and the structure (carboxylic acid residue) in which a long-chain alkyl monocarboxylic acid having an average value of a carbon number of from 27 to 50 is condensed in the amorphous polyester resin composition is preferably from 2.5% by mass to 10.0% by mass, and more preferably from 3.5% by mass to 7.5% by mass. By setting the content ratio of the components derived from long-chain alkyls within the above range, the crystallization rate of the crystalline polyester can be easily controlled, and a toner with good storage stability can be obtained.

Further, in the temperature-endothermic quantity curve of the amorphous polyester resin composition obtained by differential scanning calorimetry (DSC), a peak top temperature of the endothermic peak of the amorphous polyester resin composition is preferably from 55.0° C. to 95.0° C. The endothermic quantity (ΔH) of the endothermic peak is preferably from 0.10 J/g to 1.90 J/g, and more preferably from 0.20 J/g to 1.00 J/g.

In order to achieve both the low-temperature fixability of the toner and the suppression of image streaks, it is preferable to uniformly disperse the crystalline resin in the toner. For that purpose, it is preferable that the long-chain alkyl component is uniformly dispersed in the binder resin, and it is preferable that the amount of the components that are not bonded to the polyester resin components and are freed, that is, the amount of the unmodified aliphatic hydrocarbon be optimized.

The endothermic peak of this unmodified aliphatic hydrocarbon appears in the temperature-endothermic quantity curve obtained by differential scanning calorimetry (DSC). Where the endothermic quantity ΔH observed by DSC is within the above range, it indicates that the amount of the free long-chain alkyl component is small, that is, this component is incorporated in the amorphous polyester resin (main binder). Therefore, the present inventors believe that by optimizing the endothermic quantity (ΔH) of this endothermic peak, the component derived from a long-chain alkyl can be easily dispersed uniformly in the resin composition.

The peak top temperature and endothermic quantity (ΔH) of the endothermic peak are measured in the present invention by the following method. The peak top temperature and endothermic peak quantity of the endothermic peak by differential scanning calorimetric measurement (DSC) are measured based on ASTM D 3418-82 using a "Q2000" differential scanning calorimeter (TA Instruments). Temperature correction in the instrument detection section is performed using the melting points of indium and zinc, and the amount of heat is corrected using the heat of fusion of indium.

Specifically, approximately 5 mg of the measurement sample is accurately weighed out and this is introduced into an aluminum pan and the measurement is run at normal temperature and normal humidity at a ramp rate of 10° C./minute in the measurement temperature range between 30° C. and 200° C. using an empty aluminum pan as reference. The measurement is carried out by initially raising the temperature to 200° C., then cooling to 30° C., and then reheating. The temperature at the peak top of the maximum endothermic peak in the 30° C. to 200° C. temperature range in the DSC curve (temperature-endothermic quantity curve) obtained in this ramp up process is determined. In addition, the endothermic quantity ΔH of the endothermic peak is the integration value for the endothermic peak.

Methods for controlling the amount of free long-chain alkyl component, i.e., the endothermic peak quantity in DSC, can be exemplified by the method of increasing the alcohol modification rate or acid modification rate of the aliphatic hydrocarbon. Thus, with regard to the alcohol- or acid-modified long-chain alkyl component, it reacts with the polyester resin during the polymerization reaction and is thereby inserted into the polyester resin and as a result an endothermic peak does not appear for it in DSC measurements. The unmodified aliphatic hydrocarbon component, on the other hand, does not have a site that reacts with the polyester resin and as a consequence is present in a free state in the polyester resin and increases the endothermic quantity in DSC.

As noted above, the long-chain alkyl monoalcohol having an average of 27 to 50 carbons and the long-chain alkyl monocarboxylic acid having an average of 27 to 50 carbons that are used in the present invention are obtained industrially by the alcohol- or acid-modification of a starting aliphatic hydrocarbon. This aliphatic hydrocarbon encompasses saturated hydrocarbons and unsaturated hydrocarbons and can be exemplified by alkanes, alkenes, and alkynes and by cyclic hydrocarbons such as cyclohexane, but saturated hydrocarbons (alkanes) are preferred.

For example, for the alcohol-modified product, it is known that an aliphatic hydrocarbon having 27 to 50 carbons can be converted to the alcohol by liquid-phase oxidation with a molecular oxygen-containing gas in the presence of a catalyst such as boric acid, boric anhydride, or metaboric acid. The amount of addition for the catalyst used is preferably from 0.01 mol to 0.5 mol per 1 mol of the starting saturated hydrocarbon. A broad range of molecular oxygen-containing gases can be used for the molecular oxygen-containing gas that is injected into the reaction system, for example, oxygen, air, or these diluted with an inert gas; however, an oxygen concentration of from 3% to 20% is preferred. The reaction temperature is preferably from 100° C. to 200° C.

The endothermic quantity determined by DSC can be controlled by optimizing the reaction conditions and removing a part of the unmodified aliphatic hydrocarbon component by carrying out a purification operation after the modification reaction. The modification ratio of the aliphatic hydrocarbon component is preferably 85% or more, and more preferably 90% or more. Meanwhile, the upper limit is preferably 99% or less.

Further, the amorphous polyester resin composition preferably includes a structure in which a long-chain alkyl monoalcohol having an average value of a carbon number of from 27 to 50 is condensed at the terminal of the amorphous polyester segment, and an aliphatic hydrocarbon having an average value of a carbon number of from 27 to 50. The long-chain alkyl monoalcohol preferably includes a secondary alcohol, and more preferably includes a secondary alcohol as a main component. Having a secondary alcohol as a main component means that 50% by mass or more of the long-chain alkyl monoalcohol is a secondary alcohol.

By using a secondary alcohol as the main component of the long-chain alkyl monoalcohol, the long-chain alkyl component can easily assume a folded structure. As a result, steric hindrance or the like is suppressed, the long-chain alkyl component is likely to be present in the amorphous polyester resin composition more uniformly, and storage stability is further improved.

Where the amorphous polyester resin composition includes a hybrid resin, the long-chain alkyl component is preferably condensed at the end of the polyester segment of the hybrid resin.

That is, preferably, the amorphous polyester resin composition includes a hybrid resin having an amorphous polyester segment and a vinyl polymer segment, and an aliphatic hydrocarbon having an average number of carbon atoms of from 27 to 50, and the hybrid resin has at least one of a structure in which a long-chain alkyl monoalcohol having an average number of carbon atoms of from 27 to 50 is condensed at the end of an amorphous polyester segment, and a structure in which a long-chain alkyl monocarboxylic acid having an average number of carbon atoms of from 27 to 50 is condensed at the end of the amorphous polyester segment.

More preferably, the amorphous polyester resin composition consists of a hybrid resin having an amorphous polyester segment and a vinyl polymer segment, and an aliphatic hydrocarbon having an average number of carbon atoms of from 27 to 50, and the hybrid resin has at least one of a structure in which a long-chain alkyl monoalcohol having an average number of carbon atoms of from 27 to 50 is condensed at the end of an amorphous polyester segment, and a structure in which a long-chain alkyl monocarboxylic acid having an average number of carbon atoms of from 27 to 50 is condensed at the end of the amorphous polyester segment.

The amount of the hybrid resin in the amorphous polyester resin or the amorphous polyester resin composition is preferably from 50.0% by mass to 99.5% by mass, more preferably from 80.0% by mass to 99.0% by mass, and even more preferably from 90.0% to 99.0% by mass.

The mass ratio of the amorphous polyester segment to the vinyl polymer segment (amorphous polyester segment: vinyl polymer segment) in the hybrid resin is preferably from 60:40 to 98:2, more preferably from 65:35 to 80:20. That is, the amount of the amorphous polyester segment in the hybrid resin is preferably from 60% by mass to 98% by mass, and more preferably from 65% by mass to 80% by mass. Within these ranges, the merits of the hybrid resin can be obtained. Further, since the compatibility with the crystalline resin, particularly the crystalline polyester resin, is improved, it becomes easy to control the value of Tg1st−Tg2nd, and it is easy to obtain good low-temperature fixability.

The following compounds may be mentioned as the monomers constituting the amorphous polyester resin or amorphous polyester segment. The alcohol component can be exemplified by the following dihydric alcohols: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols given by the following formula (I) and their derivatives, and diols given by the following formula (II).

(I)

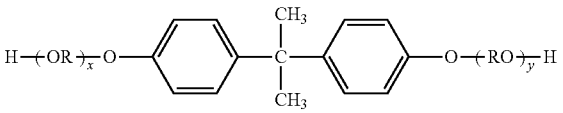

In the formula, R represents an ethylene group or propylene group; x and y are each integers equal to or greater than 0; and the average value of x+y is at least 0 and not more than 10.

(II)

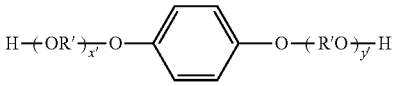

(In the formula, R' is —$CH_2CH_2$—,

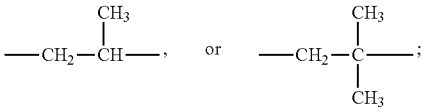

x' and y' are each integers equal to or greater than 0; and the average value of x'+y' is from 0 to 10.)

Among these, in terms of obtaining good charging performance and environmental stability, it is preferable that a bisphenol represented by the formula (I) and a derivative thereof be included. The alcohol component preferably includes a bisphenol A alkylene oxide adduct such as bisphenol A propylene oxide adduct and bisphenol A ethylene oxide adduct. That is, it is preferable that the amorphous polyester segment have a structure in which at least one alcohol component selected from the group consisting of bisphenol A propylene oxide adduct and bisphenol A ethylene oxide adduct and an acid component be polycondensed.

Further, among the bisphenol A alkylene oxide adducts, the molar ratio of the monomer unit derived from the bisphenol A propylene oxide adduct to the monomer unit derived from the bisphenol A ethylene oxide adduct (propylene oxide adduct:ethylene oxide adduct) is preferably from 50:50 to 100:0, and more preferably from 65:35 to 80:20. Within the above range, the compatibility with the crystalline resin, particularly the crystalline polyester, is improved, so that the value of Tg1st−Tg2nd can be easily controlled, and good low-temperature fixability can be easily obtained.

The monomer unit derived from the bisphenol A propylene oxide adduct and the monomer unit derived from the bisphenol A ethylene oxide adduct are preferably represented by the following formula (A). In the monomer unit derived from the bisphenol A propylene oxide adduct, in the formula (A), R represents a propylene group, x and y are each an integer of 0 or more, and the average value of x+y is from 0 to 10. In the monomer unit derived from the bisphenol A ethylene oxide adduct, in the formula (A), R represents an ethylene group, x and y are each an integer of 0 or more, and the average value of x+y is from 0 to 10.

(A)

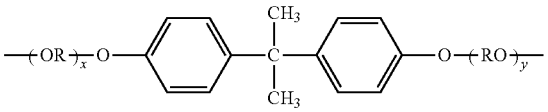

The following dibasic carboxylic acids are examples of the acid component: benzenedicarboxylic acids and anhydrides thereof, e.g., phthalic acid, terephthalic acid, isophthalic acid, and phthalic anhydride; alkyl dicarboxylic acids, e.g., succinic acid, adipic acid, sebacic acid, and azelaic acid, and their anhydrides; succinic acid substituted by an alkyl group having from 6 to 18 carbons or by an alkenyl group having from 6 to 18 carbons, and anhydrides thereof; and unsaturated dicarboxylic acids, e.g., fumaric acid, maleic acid, citraconic acid, and itaconic acid, and anhydrides thereof.

Tribasic and higher basic polybasic carboxylic acids can be exemplified by 1,2,4-benzenetricarboxylic acid (trimellitic acid), 1,2,4-cyclohexanetricarboxylic acid, 1,2,4-naphthalenetricarboxylic acid, and pyromellitic acid and their anhydrides and lower alkyl esters. Among the preceding, aromatic compounds, which are also stable to environmental fluctuations, are preferred, for example, 1,2,4-benzenetricarboxylic acid and its anhydrides. The trihydric and higher hydric polyhydric alcohols can be exemplified by 1,2,3-propanetriol, trimethylolpropane, hexanetriol, and pentaerythritol.

The amorphous polyester segment preferably has at least one selected from the group consisting of a monomer unit derived from an aliphatic diol having from 6 to 30 (more preferably from 10 to 30) carbon atoms and a monomer unit derived from an aliphatic dicarboxylic acid having from 6 to 30 (more preferably from 10 to 30) carbon atoms.

That is, it is preferable that the amorphous polyester segment have at least one selected from the group consisting of a monomer unit represented by a following formula (B) and a monomer unit represented by a following formula (C). In the following formula (B), m represents an integer of from 6 to 30 (preferably from 10 to 30). In formula (C), n represents an integer of from 4 to 28 (preferably from 8 to 28).

(B)

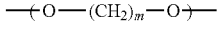

(C)

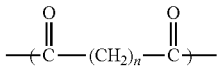

By configuring the toner as described hereinabove, a toner with improved material dispersibility and good durability that makes it possible to suppress fogging is obtained. Further, the ratio of the endothermic quantity of the endothermic peak in the reversing heat flow to the endothermic quantity in the total heat flow can be easily controlled within the specific range. The reason is considered hereinbelow.

As described above, in order to increase the ratio of the endothermic quantity of the endothermic peak in the reversing heat flow to the endothermic quantity in the total heat flow, it is important to densely fold the crystalline resin in the toner and stabilize the crystal structure. In order to densely fold the compatible crystalline resin in the toner, it is preferable to increase the molecular motion of the crystalline resin in the amorphous resin.

A monomer unit derived from an aliphatic diol and/or a monomer unit derived from an aliphatic dicarboxylic acid has higher carbon-carbon mobility than a monomer unit including aromatics, and is less likely to interfere with the molecular motion of crystalline resin. Therefore, it is considered that the ratio of the endothermic quantity of the endothermic peak in the reversing heat flow to the endothermic quantity in the total heat flow can be increased.

Assuming that the total of the monomer units other than the monomer unit represented by the above formula (B) among the monomer units derived from the alcohol component in the amorphous polyester segment is 100 mol parts, the total amount of the monomer unit represented by the formula (B) and the monomer unit represented by the formula (C) is preferably from 1 mol part to 20 mol parts, and more preferably from 3 mol parts to 15 mol parts. By configuring the toner as described hereinabove, the material dispersibility is improved, fogging can be suppressed, and good durability can be obtained. Further, the ratio of the endothermic quantity of the endothermic peak in the reversing heat flow to the endothermic quantity in the total heat flow can be easily controlled within the specific range.

The following compounds are examples of the vinylic monomer for forming the vinyl polymer segment: styrene and its derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; methacrylate esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylate esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalene; and derivatives of acrylic acid or methacrylic acid such as acrylonitrile, methacrylonitrile, and acrylamide.

The following are additional examples: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; the half esters of unsaturated dibasic acids, such as the methyl half ester of maleic acid, ethyl half ester of maleic acid, butyl half ester of maleic acid, methyl half ester of citraconic acid, ethyl half ester of citraconic acid, butyl half ester of citraconic acid, methyl half ester of itaconic acid, methyl half ester of alkenylsuccinic acid, methyl half ester of fumaric acid, and methyl half ester of mesaconic acid; esters of unsaturated dibasic acids, such as dimethyl maleate and dimethyl fumarate; α,β-unsaturated acids such as acrylic acid, methacrylic acid, crotonic acid, and cinnamic acid; the anhydrides of α,β-unsaturated acids, such as crotonic anhydride and cinnamic anhydride; anhydrides between an α,β-unsaturated acid and a lower fatty acid; and carboxyl group-containing monomers such as alkenylmalonic acid, alkenylglutaric acid, and alkenyladipic acid and their anhydrides and monoesters.

Additional examples are esters of acrylic acid or methacrylic acid, such as 2-hydroxyethyl acrylate, 2-hydroxyethyl methacrylate, and 2-hydroxypropyl methacrylate, and hydroxy group-containing monomers such as 4-(1-hydroxy-1-methylbutyl)styrene and 4-(1-hydroxy-1-methylhexyl) styrene. Preferably, polystyrene, a styrene-methacrylic acid ester copolymer, a styrene-acrylic acid ester copolymer, or a styrene-(meth)acrylic acid copolymer.

The vinyl polymer segment of the hybrid resin may have a crosslinked structure crosslinked with a crosslinking agent having two or more vinyl groups. Examples of the crosslinking agent used in this case include the following. Aromatic divinyl compounds (divinylbenzene, divinylnaphthalene); diacrylate compounds linked by an alkyl chain (ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds in which acrylate is replaced with methacrylate); diacrylate compounds linked by an alkyl chain including an ether bond (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds in which acrylate is replaced with methacrylate); diacrylate compounds linked by a chain including an aromatic group and an ether bond [polyoxyethylene (2)-2,2-bis(4-hydroxyphenyl)propane diacrylate, polyoxyethylene (4)-2,2-bis(4-hydroxyphenyl)propane diacrylate, and the above compounds in which acrylate is replaced with methacrylate]; polyester type diacrylate compounds ("MANDA" manufactured by Nippon Kayaku Co., Ltd.).

Examples of the polyfunctional crosslinking agent include the following. Pentaerythritol triacrylate, trimethylolethane triacrylate, trimethylolpropane triacrylate, tetramethylolmethane tetraacrylate, oligoester acrylate, and the above compounds in which acrylate is replaced with methacrylate; triallyl cyanurate, triallyl trimellitate. The addition amount of these crosslinking agents is preferably from 0.01 parts by mass to 10.00 parts by mass, and more preferably from 0.03 parts by mass to 5.00 parts by mass with respect to 100 parts by mass of the monomers other than the crosslinking agent.

Among these crosslinking agents, examples of those preferably used for polyester-including resin compositions from the viewpoint of fixability and offset resistance include aromatic divinyl compounds (in particular, divinylbenzene) and diacrylate compounds linked by a chain including an aromatic group and an ether bond.

Examples of the polymerization initiator to be used for the polymerization of the vinyl polymer segment include the following.

2,2'-Azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides such as methyl ethyl ketone peroxide, acetylacetone peroxide, and cyclohexanone peroxide, 2,2-bis(tert-butyl peroxy) butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α,α'-bis (tert-butyl peroxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, di-isopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, tert-butyl peroxyacetate, tert-butyl peroxyisobutyrate, tert-butyl peroxyneodecanoate, tert-butylperoxy2-ethylhexanoate, tert-butylperoxylaurate, tert-butyl peroxybenzoate, tert-butyl peroxyisopropyl carbonate, di-tert-butyl peroxyisobutyrate, tert-butylperoxyallyl carbonate, tert-amyl peroxy-2-ethyl hexanoate, di-tert-butyl peroxyhexahydroterephthalate, and di-tert-butylperoxyazelate.

A method for hybridizing the vinyl polymer segment and the polyester segment is not particularly limited, and examples thereof include the following methods. A method in which a monomer component capable of reacting with both components is included in the vinyl polymer segment and/or the polyester segment, and a method in which the polyester segment is transesterified with the vinyl polymer segment including an ester-derived structural unit.

Crystalline Polyester Resin

The toner particle includes a crystalline resin. The crystalline resin preferably includes a crystalline polyester resin, and the crystalline resin is more preferably a crystalline polyester resin. A crystalline resin is defined as a resin having a clear endothermic peak as measured by a differential scanning calorimetry (DSC). A crystalline polyester resin will be described.

A known crystalline polyester resin can be used. For example, a polycondesate of an acid component including an aliphatic dicarboxylic acid and an alcohol component including an aliphatic diol can be mentioned. The crystalline polyester resin is preferably a polycondensate of an aliphatic dicarboxylic acid and an aliphatic diol, and at least one selected from the group consisting of an aliphatic monocarboxylic acid and an aliphatic monoalcohol. The crystalline polyester resin is more preferably a polycondensate of an aliphatic dicarboxylic acid, an aliphatic diol, and an aliphatic monocarboxylic acid.

Examples of the aliphatic dicarboxylic acid include an aliphatic dicarboxylic acid having from 2 to 20 carbon atoms. Examples thereof include oxalic acid, malonic acid, succinic acid, glutaric acid, adipic acid, pimelic acid, suberic acid, azelaic acid, sebacic acid, dodecanedioic acid, hexadecanedicarboxylic acid, octadecanedicarboxylic acid, and the like.

Examples of the aliphatic diol include an aliphatic diol having from 2 to 20 carbon atoms. Examples thereof include ethylene glycol, diethylene glycol, triethylene glycol, 1,2-propanediol, 1,3-propanediol, dipropylene glycol, trimethylene glycol, neopentyl glycol, 1,4-butanediol, 1,6-hexanediol, 1,7-heptanediol, 1,8-octanediol, 1,9-nonanediol, 1,10-decanediol, 1,11-undecanediol, 1,12-dodecanediol, 1,16-hexadecanediol, 1,18-octadecanediol, and the like.

Examples of the aliphatic monocarboxylic acid include an aliphatic monocarboxylic acid having from 6 to 20 carbon atoms. Examples thereof include hexanoic acid, heptanoic acid, octanoic acid, nonanoic acid, decanoic acid (capric acid), dodecanoic acid (lauric acid), tetradecanoic acid (myristic acid), hexadecanoic acid (palmitic acid), octadecanoic acid (stearic acid), eicosanic acid (arachidic acid), docosanoic acid (behenic acid), tetracosanoic acid (lignoselic acid), and the like.

Examples of the aliphatic monoalcohol include an aliphatic monoalcohol having from 6 to 20 carbon atoms. Examples thereof include capryl alcohol, undecanol, lauryl alcohol, tridecanol, myristyl alcohol, pentadecanol, palmityl alcohol, margaryl alcohol, stearyl alcohol, nonadecanol, arachidyl alcohol, and the like.

The crystalline polyester resin is preferably a polycondensate of an alcohol component including an aliphatic diol and an acid component including an aliphatic dicarboxylic acid. Assuming that the number of carbon atoms of the aliphatic diol is C1 and the number of carbon atoms of the aliphatic dicarboxylic acid is C2, the sum of C1 and C2 is preferably from 8 to 16, more preferably from 10 to 16, and even more preferably from 12 to 16.

When a plurality of aliphatic diols and/or aliphatic dicarboxylic acids is used, the average value by mass fraction is adopted for the number of carbon atoms in each component. When the sum of C1 and C2 is from 8 to 16, it means that the total number of carbon atoms of the aliphatic diols and the aliphatic dicarboxylic acids constituting the crystalline polyester resin is relatively small. Thus, by reducing the sum of C1 and C2 to the abovementioned range, the concentration of ester groups contained in the crystalline polyester resin is increased, and the polarity of the crystalline polyester resin is increased. As a result, when the amorphous polyester resin is used as the binder resin, the compatibility with the amorphous polyester resin is improved, so that the value of Tg1st−Tg2nd can be easily controlled within the range of the present case.

Further, where the sum of C1 and C2 is set to 8 or more, the crystalline polyester resin can easily form a stable crystal structure, and the ratio of the endothermic quantity of the endothermic peak in the reversing heat flow to the endothermic quantity in the total heat flow of can be easily controlled to the above specific range.

Further, the crystalline polyester resin is a polycondensate of an alcohol component including an aliphatic diol and an acid component including an aliphatic dicarboxylic acid, and assuming that the number of carbon atoms of the aliphatic diol is C1 and the number of carbon atoms of the aliphatic dicarboxylic acid is C2, it is preferable to satisfy the following formula (2) or (3).

$$2 \leq C1 \leq 4 \quad (2)$$

$$2 \leq C2 \leq 4 \quad (3)$$

This means that the number of carbon atoms between the ester groups of the crystalline polyester resin is very small. The presence of these two ester groups close to each other creates a highly polar structure in which the two ester groups are in close proximity to each other in the molecule of the crystalline polyester resin, resulting in a large polarity bias in the molecule.

In the crystalline polyester resin, intramolecular interaction induced by polarity bias promotes recrystallization which makes it easier to create a stable crystal structure. That is, it becomes easy to control the ratio of the endothermic quantity flow of the endothermic peak in the reversing heat flow to the endothermic quantity in the total heat flow within the above specific range.

The crystalline polyester resin is a polycondensation of an alcohol component including an aliphatic diol and an acid component including an aliphatic dicarboxylic acid, and preferably has at least one of a structure in which an aliphatic monocarboxylic acid is condensed on the terminal and a structure in which an aliphatic monoalcohol is condensed on the terminal.

The carbon number of at least one of the structure in which the aliphatic monocarboxylic acid is condensed and the structure in which the aliphatic monoalcohol is condensed is preferably from 6 to 14, and more preferably from 10 to 14.

The melting point of the crystalline polyester resin is preferably from 65° C. to 100° C., and more preferably from 70° C. to 90° C. The melting point is determined by the combination of the carboxylic acid component and the alcohol component used, and may be selected, as appropriate, so as to fall within the above range.

The amount of the crystalline polyester resin is preferably from 5 parts by mass to 30 parts by mass, more preferably from 8 parts by mass to 30 parts by mass, even more preferably from 10 parts by mass to 25 parts by mass, and further preferably from 10 parts by mass to 20 parts by mass with respect to 100 parts by mass of the binder resin.

The crystalline polyester resin can be manufactured by the usual polyester synthesis method. For example, the crystalline polyester resin can be obtained by subjecting an acid component and an alcohol component to an esterification reaction or a transesterification reaction, and then performing a polycondensation reaction under a reduced pressure or by introducing a nitrogen gas according to a conventional method.

At the time of the esterification or transesterification reaction, a normal esterification catalyst or transesterification catalyst such as sulfuric acid, tertiary butyl titanium butoxide, dibutyltin oxide, manganese acetate, magnesium acetate, or the like can be used if necessary. Regarding polymerization, it is possible to use a usual polymerization catalyst such as tert-butyl titanium butoxide, dibutyltin oxide, tin acetate, zinc acetate, tin disulfide, antimony trioxide, germanium dioxide, and the like. The polymerization temperature and the amount of catalyst are not particularly limited and may be arbitrarily selected as needed. It is desirable that a titanium catalyst be used as the catalyst, and a chelate-type titanium catalyst is more desirable. This is because the reactivity of the titanium catalyst is appropriate and a polyester having a desired molecular weight distribution can be obtained.

Assuming that the number of carbon atoms of a monomer unit having the largest number of carbon atoms among the monomer unit represented by the formula (B) and the monomer unit represented by the formula (C) in the amorphous polyester segment is C3, and the number of carbon atoms of a component having the largest number of carbon atoms among the aliphatic diol and the aliphatic dicarboxylic acid compound constituting the crystalline polyester resin is C4, the absolute value |C3−C4| of the difference between C3 and C4 is preferably from 0 to 6.

Where the value of |C3−C4| satisfies the above range, it means that the amorphous resin and the crystalline resin include a similar structure. Since the components having similar structures are readily compatible and easily miscible with each other, the dispersibility of the crystalline resin in the amorphous resin is improved. Therefore, it is possible to obtain a toner in which the dispersibility of the crystalline resin in the amorphous resin is improved and fogging can be suppressed. Further, the ratio of the endothermic quantity of the endothermic peak in the reversing heat flow to the endothermic quantity in the total heat flow can be easily controlled within the above specific range.

Colorant

A colorant may be used in the toner particle. Examples of the colorant include the following organic pigments, organic dyes, and inorganic pigments. Examples of cyan colorants include copper phthalocyanine compounds and derivatives thereof, anthraquinone compounds, and basic dye lake compounds. Examples of magenta colorants are presented hereinbelow. Condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Examples of yellow colorants include condensed azo compounds, isoindolinone compounds, anthraquinone compounds, azo metal complexes, methine compounds, and allylamide compounds. Examples of black colorants include carbon black, and those toned in black using the abovementioned yellow-based colorant, magenta-based colorant, cyan-based colorant, and magnetic powder. These colorants can be used alone or in a mixture, and can also be used in a solid solution state. The colorant is selected from the viewpoints of hue angle, saturation, brightness, light resistance, OHP transparency, and dispersibility in a toner particle. The amount of the colorant is preferably from 1 part by mass to 10 parts by mass with respect to 100 parts by mass of the binder resin.

Magnetic Particles

Magnetic particles may be used as the black colorant. When using magnetic particles, it is preferable to have a core particle including a magnetic iron oxide particle and a coating layer provided on the surface of the core particle. The core particle including the magnetic iron oxide particles can be exemplified by magnetic iron oxides such as magnetite, maghemite, and ferrite and magnetic iron oxides that contain other metal oxides, and by metals such as Fe, Co, and Ni and alloys of these metals with metals such as Al, Co, Cu, Pb, Mg, Ni, Sn, Zn, Sb, Be, Bi, Cd, Ca, Mn, Ti, W, and V, and their mixtures.

The coating layer may cover the entire surface of the core particle uniformly, or may cover the surface of the core particle in a partially exposed state. In either of the coating modes, the coating layer is preferably the outermost layer, and the surface of the core particles is preferably thinly coated. It is preferable that Si and Al be contained as elements forming the coating layer. A method for forming the coating layer is not particularly limited, and a known method may be used. For example, after producing core particles including magnetite, a silicon source or an aluminum source such as sodium silicate or aluminum sulfate is added to a ferrous sulfate aqueous solution. Then, a coating layer including a specific oxide on the surface of the core particle may be formed by blowing air while adjusting the pH and temperature of the mixed solution. Further, the thickness of the coating layer can be controlled by adjusting the addition amount of ferrous sulfate aqueous solution, sodium silicate, aluminum sulfate, and the like.

Further, from the viewpoint of facilitating the formation of the above-described coating layer and improving magnetic properties and tinting strength, the magnetic particles preferably have an octahedral shape. As a method for controlling the shape of magnetic particles, a conventionally known method can be adopted. For example, magnetic particles can be formed into an octahedral shape by adjusting the pH during a wet oxidation reaction to 9 or more in the production of core particles. From the viewpoint of low-temperature fixability, the amount of the magnetic particles is preferably from 25 parts by mass to 100 parts by mass, and more preferably from 30 parts by mass to 90 parts by mass with respect to 100 parts by mass of the binder resin.

Other Constituent Materials of Toner

It is preferable that the toner particle include a release agent (wax) in order to give the toner releasability. The following are specific examples of wax: oxides of aliphatic hydrocarbon waxes, such as oxidized polyethylene wax, and their block copolymers; waxes in which the major component is fatty acid ester, such as carnauba wax, sasol wax, and montanic acid ester waxes; and waxes provided by the partial or complete deacidification of fatty acid esters, such as deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; long-chain alkyl alcohols; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N□-dioleyladipamide, and N,N-dioleylsebacamide; aromatic bisamides such as m-xylenebisstearamide and N,N-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters between a polyhydric alcohol and a fatty acid, such as behenic monoglyceride; and hydroxyl group-containing methyl ester compounds obtained by the hydrogenation of plant oils.

The following are specific examples: VISKOL (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Sasol Wax GmbH); HNP-1, HNP-3, HNP-9, HNP-10, HNP-11, and HNP-12 (Nippon Seiro Co., Ltd.); UNILIN (registered trademark) 350, 425, 550, and 700 and UNICID (registered trademark) 350, 425, 550, and 700 (Toyo Petrolite Co., Ltd.); and Japan Wax, Beeswax, Rice Wax, Candelilla Wax, and Carnauba Wax (Cerarica NODA Co., Ltd.).

From the viewpoint of low-temperature fixability, the melting point of the wax is preferably from 65.0° C. to 120.0° C. The wax amount is preferably from 0.1 parts by mass to 20 parts by mass, and more preferably from 0.5 parts by mass to 10 parts by mass with respect to 100 parts by mass of the binder resin.

The toner may contain a charge control agent in order to stabilize its triboelectric charging behavior. The content of the charge control agent, while also varying as a function of its type and the properties of the other constituent materials of the toner, is generally, per 100 mass parts of the binder resin, preferably from 0.1 mass parts to 10 mass parts and more preferably from 0.1 mass parts to 5 mass parts. Charge control agents that control the toner to a negative charging performance and charge control agents that control the toner to a positive charging performance are known for charge control agents, and a single one of the various charge control agents or two or more can be used depending on the toner type and application.

The following are examples of charge control agents for controlling the toner to a negative charging performance: organometal complexes (monoazo metal complexes, acetylacetone metal complexes); the metal complexes and metal salts of aromatic hydroxycarboxylic acids and aromatic dicarboxylic acids; aromatic mono- and polycarboxylic acids and their metal salts and anhydrides; and phenol derivatives such as esters and bisphenols.

The following are examples of charge control agents for controlling the toner to a positive charging performance: nigrosine and its modifications by fatty acid metal salts; quaternary ammonium salts such as tributylbenzylammonium 1-hydroxy-4-naphthosulfonate and tetrabutylammonium tetrafluoroborate, and their analogues; onium salts such as phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanic acid, and ferrocyanic compounds); and metal salts of higher fatty acids. Nigrosine compounds and quaternary ammonium salts, for example, are preferred among the preceding.

A charge control resin may also be used, and it may also be used in combination with the charge control agents cited above. Specific examples of the charge control agents are as follows: Spilon Black TRH, T-77, T-95, and TN-105 (Hodogaya Chemical Co., Ltd.); BONTRON (registered trademark) S-34, S-44, E-84, and E-88 (Orient Chemical Industries Co., Ltd.); TP-302 and TP-415 (Hodogaya Chemical Co., Ltd.); BONTRON (registered trademark) N-01, N-04, N-07, and P-51 (Orient Chemical Industries Co., Ltd.); and Copy Blue PR (Clariant International Ltd,).

The toner may have silica fine particles or the like as an external additive in order to improve charging stability, durable developing property, flowability and durability. This silica fine particles have a specific surface area by the nitrogen adsorption-based BET method preferably of at least 30 $m^2/g$ and more preferably from 50 $m^2/g$ to 400 $m^2/g$. The amount of the silica fine particles expressed per 100 mass parts of the toner particle is preferably at from 0.01 mass parts to 8.00 mass parts and more preferably at from 0.10 mass parts to 5.00 mass parts.

The BET specific surface area of the silica fine particles can be determined using a multipoint BET method by the adsorption of nitrogen gas to the surface of the silica fine particles using, for example, an Autosorb 1 specific surface area analyzer (Yuasa Ionics Co., Ltd.), a GEMINI 2360/2375 (Micromeritics Instrument Corporation), or a TriStar-3000 (Micromeritics Instrument Corporation). For the purpose of controlling the triboelectric charging characteristics, the silica fine particles are optionally preferably also treated with a treatment agent, e.g., an unmodified silicone varnish, various modified silicone varnishes, an unmodified silicone oil, various modified silicone oils, a silane coupling agent, a functional group-bearing silane compound, or other organosilicon compounds, or with a combination of different treatment agents.

Other external additives may also be added to the toner on an optional basis. These external additives can be exemplified by resin fine particles and inorganic fine particles that function as an auxiliary charging agents, agents that impart electroconductivity, flowability-imparting agents, anti-caking agents, release agents for hot roll fixing, lubricants, abrasive, and so on. The lubricant can be exemplified by polyethylene fluoride powders, zinc stearate powders, and polyvinylidene fluoride powders. The abrasive can be exemplified by cerium oxide powders, silicon carbide powders, and strontium titanate powders. Strontium titanate powders are preferred among the preceding.

The toner may be used as a two-component developer by mixing with a carrier. An ordinary carrier, e.g., ferrite, magnetite, and so forth, or a resin-coated carrier may be used as the carrier. A binder-type carrier, in which a magnetic body is dispersed in a resin, may also be used.

Resin-coated carriers comprise a carrier core particle and a coating material, i.e., a resin, coated on the surface of the carrier core particle. The resins used for the coating material can be exemplified by styrene-acrylic resins such as styrene-acrylate ester copolymers and styrene-methacrylate ester copolymers; acrylic resins such as acrylate ester copolymers and methacrylate ester copolymers; fluororesins such as polytetrafluoroethylene, monochlorotrifluoroethylene polymers, and polyvinylidene fluoride; silicone resins; polyester resins; polyamide resins; polyvinyl butyral; and aminoacrylate resins. Other examples include ionomer resins and polyphenylene sulfide resins. These resins can be used alone or in combination of two or more.

Method for Producing Toner

A method for producing the toner is not particularly limited, and a known production method can be adopted. Hereinafter, a method for producing the toner through a melt-kneading step and a pulverization step will be specifically illustrated, but this method is not limiting.

For example, the binder resin comprising the amorphous resin, and the crystalline polyester resin, and optionally colorant, a release agent, charge control agent, and other additives may be thoroughly mixed using a mixer such as a Henschel mixer or a ball mill (mixing step). The resulting mixture may be melt-kneaded using a heated kneader such as a twin-screw kneader-extruder, hot roll, kneader, or extruder (melt-kneading step). The resulting melt-kneaded material may be cooled and solidified and then pulverized using a pulverizer (pulverization step), followed by classification using a classifier (classification step) to obtain toner particles. The toner particles may optionally also be mixed with an external additive using a mixer such as a Henschel mixer to obtain a toner.

The mixer can be exemplified by the following: the FM mixer (Nippon Coke & Engineering Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneading apparatus can be exemplified by the following: the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

The following screening devices may be used to screen out the coarse particles: Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

It is preferable to apply a mechanical impact force when mixing the external additive. The "mechanical impact force" is a force applied between the stirring part of the mixing device and the bottom or wall surface of the container. The mechanical impact force at the time of external addition is applied to the toner surface through the external addition or directly. At this time, due to micro-vibration generated in molecular chains by the impact force, the crystalline segments in the crystalline resin approach each other and crystallization is promoted. Since the vibration of molecular chains due to this impact force is extremely short, the orientation and crystallization of the crystalline segments that are relatively close to each other are induced. Therefore, such vibration is a means that contributes to an increase in the components appearing in the reversing heat flow and an increase in the ratio thereof.

However, it is practically difficult to induce sufficient crystallization purely by impact force alone, and it is preferable to input thermal energy by heating. It is preferable to reach as quickly as possible the optimum processing temperature for crystallization which promotes the most crystallization at that time and does not cause crystal melting.

In addition, since thermal energy is a continuous molecular vibration, it also causes orientation and crystallization of crystalline segments at relatively long distances from each other. The lower the temperature, the longer the time required for crystallization. Therefore, since the crystalline resin molecules are given time to move and the crystalline segments at a longer distance from each other are given an opportunity to approach each other the effect thereof is more prominent. As a result, the components appearing in the reversing heat flow are reduced, and the ratio thereof is reduced. In order to maximize the components appearing in the reversing heat flow, it is preferable to reach the optimum processing temperature within 15 min at the maximum.

In the external addition step of mixing the external additive with the toner particle, a rotating body as shown in FIGS. 1A and 1B can be used as the processing blade. FIG. 1A is a top view and FIG. 1B is a side view. The processing blade 140 collides with a flowing object to be processed and processes the object. The processing blade 140 is configured of an annular processing blade main body 141 and a processing portion 142 protruding outward in the radial direction from the outer peripheral surface of the main body 141. The processing blade 140 is preferably made of a metal such as iron or SUS from the viewpoint of strength, and may be plated or coated for wear resistance if necessary. A known mixing device, for example, a processing blade such as an FM mixer can be used by changing to such a rotating body.

In the external process step, it is preferable to control the processing temperature. The processing temperature can be controlled by, for example, flowing water adjusted to a predetermined temperature through the jacket of the mixing device, introducing hot air adjusted to a predetermined temperature into the mixing device, and the like. The temperature inside the tank in the external process step is measured by installing a temperature sensor in the device. The installation position of the temperature sensor can be on the wall surface of the device, the fixing member in the device, and the like.

It is preferable that the processing temperature of the external addition step reach the optimum treatment temperature within 15 min, and then the processing temperature be maintained. The rate of temperature rise is preferably 5 degrees/min or more. For example, the processing temperature can be preferably from 30° C. to 60° C., and more preferably from 40° C. to 55° C. Further, if necessary, a second external addition step may be carried out. As the second external addition step, the desired external additive may be newly added and the external addition treatment may be performed by a mixer such as a Henschel mixer.

Next, the measurement method of each physical property will be described.

Measurement by Temperature-Modulated Differential Scanning Calorimeter (MDSC)

As a temperature-modulated differential scanning calorimeter, a differential scanning calorimetry device "Q2000" (manufactured by TA Instruments) is used. In addition, the measurement is carried out according to ASTM D3418-82. Specifically, about 5 mg of toner is precisely weighed and placed in an aluminum pan, an empty aluminum pan is used as a reference, and measurement is conducted under the following conditions.

Measurement Conditions

Measurement mode: Modulation mode
Temperature rise rate: 1.0° C./min
Modulation temperature amplitude: ±0.318° C./min
Measurement start temperature: 40° C.
Measurement end temperature: 120° C.

Calculation of Peak Temperature and Endothermic Quantity ΔH1 of Endothermic Peak in Total Heat Flow After the above measurement is completed, "Heat Flow" is plotted against the ordinate, the temperature is plotted against the abscissa, and the peak top temperature and the endothermic quantity ΔH1 (J/g) of each endothermic peak in the total heat flow are obtained for all endothermic peaks present in the temperature range of from 55° C. to 95° C.

Calculation of Ratio of Endothermic Quantity of Endothermic Peak in Reversing Heat Flow to Endothermic Quantity of Endothermic Peak in Total Heat Flow "Reversing Heat Flow" is plotted against the ordinate, the temperature plotted against the abscissa, and the endothermic quantity ΔH2 (J/g) of each endothermic peak in the reversing heat flow is obtained within the same temperature range as the range in which the endothermic quantity ΔH1 in the total heat flow was obtained for each endothermic peak for which the endothermic quantity was obtained in the total heat flow. ΔH1 and ΔH2 corresponding to each endothermic peak are obtained for all endothermic peaks present in the temperature range of from 55° C. to 95° C. The ratio (%) of the endothermic quantity of each endothermic peak in the reversing heat flow to the endothermic quantity in the total heat flow (merely, referred as "endothermic quantity ratio (%)") is calculated according to the following formula $$\text{Endothermic quantity ratio (\%)}=[\Delta H2/\Delta H1]\times 100.$$

Here, where a plurality of endothermic peaks is present in a temperature range of from 55° C. to 95° C., the average value of the endothermic quantity ratios by mass fraction is adopted. To identify whether each endothermic peak is derived from a crystalline resin, the resin is extracted with a solvent (for example, methyl ethyl ketone) corresponding to the peak temperature, and composition analysis is performed using a pyrolysis GC-Mass and an infrared spectrophotometer (IR). Based on the identification, an endothermic peak including a peak derived from the crystalline resin is defined as an endothermic peak derived from the crystalline resin.

Measurement of Tg1st and Tg2nd

Modulation measurement is performed according to the abovementioned measurement conditions. Further, when the measurement temperature reaches 120° C., the temperature is maintained for 1 min and then lowered from 120° C. to 0° C. at 10° C./min. The second temperature rise step is performed again with the above settings, and the modulation measurement is performed. The glass transition temperature (Tg) is obtained from the obtained reversing heat flow curve by a midpoint method. That is, the intersection of a line passing through a midpoint of a baseline before the specific heat change in the reversing heat flow curve appears and a baseline after the specific heat change appears, and the reversing heat flow curve is taken as a glass transition temperature. The glass transition temperature in the first temperature rise is denoted by Tg1st, and the glass transition temperature in the second temperature rise is denoted by Tg2nd.

Analysis of Structure of the Crystalline Resin from Toner

The molecular structure of the crystalline resin such as the crystalline polyester resin can be confirmed by NMR measurement with a solution or a solid sample and also by a known analysis method such as X-ray diffraction, GC/MS, LC/MS, IR measurement, and the like. Also, a known method can be used for isolating the crystalline resin such as the crystalline polyester resin from the toner.

Specifically, the isolation operation is performed in the following manner. First, the toner is dispersed in ethanol, which is a poor solvent for the toner, and the temperature is raised to a temperature exceeding the melting point of the crystalline resin. At this time, pressure may be applied if necessary. At this point in time, the crystalline resin having a temperature above the melting point is melted. After that, the crystalline resin can be collected from the toner by solid-liquid separation.

Composition Analysis of Amorphous Resin

The molecular structure of the amorphous resin can be confirmed by known analytical methods such as X-ray diffraction, GC/MS, LC/MS, and IR measurement, in addition to NMR measurement using a solution or solid matter. The amorphous resin can also be isolated from the toner and analyzed by the following procedure.

Separation of Amorphous Resin and Crystalline Resin from Toner

An example of a method for separating an amorphous resin and a crystalline resin from the toner is described hereinbelow. Separation is performed by the following method, and it is further possible to specify the structure and specify physical properties, for example, calculate the SP value.

Separation of Wax from Toner by Preparative Gel Permeation Chromatography (GPC)

The toner is dissolved in tetrahydrofuran (THF), and the solvent is distilled off under reduced pressure from the obtained soluble component to obtain a tetrahydrofuran (THF) soluble component of the toner. The tetrahydrofuran (THF)-soluble component of the obtained toner is dissolved in chloroform to prepare a sample solution having a concentration of 25 mg/ml. A total of 3.5 ml of the obtained sample solution is injected into the following apparatus, and a fraction with a number average molecular weight (Mn) of 2000 or more is separated as a resin component under the following conditions.

Preparative GPC device: Preparative HPLC LC-980 manufactured by Nippon Analytical Industry Co., Ltd.

Preparative columns: JAIGEL 3H, JAIGEL 5H (manufactured by Nippon Analytical Industry Co., Ltd.)

Eluent: Chloroform

Flow velocity: 3.5 ml/min

In calculating the molecular weight of the sample, a molecular weight calibration curve prepared using standard polystyrene resin (for example, trade names "TSK standard polystyrene F-850, F-450, F-288, F-128, F-80, F-40, F-20, F-10, F-4, F-2, F-1, A-5000, A-2500, A-1000, A-500", manufactured by Tosoh Corporation) is used. After separating the high molecular weight component derived from the resin, the solvent is distilled off under reduced pressure, followed by further drying in an atmosphere of 90° C. under reduced pressure for 24 h. The above operation is repeated until about 100 mg of the resin component is obtained.

Separation of Amorphous Resin and Crystalline Resin

A total of 500 ml of acetone is added to 100 mg of the resin obtained in the above operation, and heating to 70° C. is performed to completely dissolve the resin. The crystalline resin is then recrystallized by gradually cooling to 25° C. The recrystallized crystalline resin and filtrate are separated by suction filtration. The separated filtrate is gradually added to 500 ml of methanol to reprecipitate the amorphous resin, and then the amorphous resin and the filtrate are separated by a suction filter. The obtained amorphous resin and crystalline resin are dried under reduced pressure at 40° C. for 24 h.

Method for Measuring Softening Point of Resins

The softening point of the resins is measured using a "Flowtester CFT-500D Flow Property Evaluation Instrument" (Shimadzu Corporation), a constant-load extrusion-type capillary rheometer, in accordance with the manual provided with the instrument. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point. The melting temperature by the ½ method is determined as follows. First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches the sum of X and Smin is the melting temperature by the ½ method.

The measurement sample used is prepared by subjecting approximately 1.0 g of the resin to compression molding for approximately 60 seconds at approximately 10 MPa in a 25° C. environment using a tablet compression molder (for example, NT-100H, NPa System Co., Ltd.) to provide a cylindrical shape with a diameter of approximately 8 mm.

The measurement conditions with the CFT-500D are as follows.

Test mode: ramp-up method
Start temperature: 40° C.
Saturated temperature: 200° C.
Measurement interval: 1.0° C.
Ramp rate: 4.0° C./min
Piston cross section area: 1.000 $cm^2$
Test load (piston load): 10.0 $kgf/cm^2$ (0.9807 MPa)
Preheating time: 300 seconds
Diameter of die orifice: 1.0 mm
Die length: 1.0 mm

EXAMPLES

The present invention will be specifically described hereinbelow based on the following examples. However, the present invention is not limited thereto. In the following formulations, parts is based on mass unless otherwise specified.

Production Example of Long-Chain Alkyl Monomer (W-1)

A total of 1200 parts of a chain saturated hydrocarbon having an average value of a carbon number of 35 was placed in a glass cylindrical reaction vessel, and 38.5 parts of boric acid was added at a temperature of 140° C. Immediately thereafter, a mixed gas of 50% by volume of air and 50% by volume of nitrogen with an oxygen concentration of about 10% by volume was blown at a rate of 20 L/min, and the reaction was carried out at 200° C. for 3.0 hours. After the reaction, warm water was added to the reaction solution, hydrolysis was carried out at 95° C. for 2 hours, the product was allowed to stand, and then a reaction product (modified product) in the upper layer was obtained.

A total of 20 parts of the obtained modified product was added to 100 parts of n-hexane and purified to dissolve and remove a part of the unmodified component to obtain a long-chain alkyl monomer (W-1). The long-chain alkyl monomer (W-1) had a modification ratio of 93.6% by mass, that is, contained 6.4% by mass of aliphatic hydrocarbon. The average number of carbon atoms was 35.

Production Example of Resin Composition (A-1)

| | |
|---|---|
| Bisphenol A ethylene oxide adduct (2.0 mol adduct) | 30.0 mol parts |
| Bisphenol A propylene oxide adduct (2.3 mol adduct) | 70.0 mol parts |
| Terephthalic acid | 57.0 mol parts |
| Sebacic acid | 3.0 mol parts |
| Trimellitic anhydride | 15.0 mol parts |
| Acrylic acid | 10.0 mol parts |

In addition to 70 parts of the polyester monomer, a long-chain alkyl monomer (W-1) was added so as to obtain 2.5% by mass of the total polyester resin composition. The obtained mixture was charged into a four-necked flask, a decompression device, a water separator, a nitrogen gas introduction device, a temperature measuring device and a stirrer were mounted, and stirring was conducted at 160° C. under a nitrogen atmosphere. A mixture of 30 parts of a vinyl-based polymerization monomer (styrene: 100.0 mol parts) constituting a vinyl polymer segment and 2.0 mol parts of benzoyl peroxide as a polymerization initiator were added dropwise thereto from the dropping funnel over 4 h. Then, after reacting at 160° C. for 5 h, the temperature was raised to 230° C., 0.2% by mass of dibutyltin oxide was added, and the reaction time was adjusted so as to obtain the desired viscosity. After completion of the reaction, the reaction product was taken out from the container, cooled and pulverized to obtain a resin composition (A-1). Table 1 shows various physical characteristics.

Production Examples of Resin Compositions (A-2) to (A-19)

Resin compositions (A-2) to (A-19) were obtained in the same manner as in the production example of the resin composition (A-1) except that the monomer formulation was changed to that shown in Table 2. Table 1 shows various physical characteristics.

Production Example of Resin Composition (A-20)

The alcohol components and carboxylic acid components (total 6740 g) other than adipic acid and trimellitic anhydride that are shown in Table 2, 45 g of tin (II) 2-ethylhexanoate, and 5 g of gallic acid were placed in a 10-liter four-necked flask equipped with a nitrogen introduction tube, a dehydration tube equipped with a distillation tube through which hot water at 100° C. was passed, a stirrer and a thermocouple. After keeping the temperature at 180° C. for 1 h in a nitrogen atmosphere, the temperature was raised from 180° C. to 230° C. at 10° C./h, and then a polycondensation reaction was carried out at 230° C. for 6 h. After reacting at 230° C. at 8.0 kPa for 1 h, adipic acid and trimellitic anhydride were further reacted at 210° C., and the reaction time was adjusted to obtain the desired viscosity at 10 kPa. After completion of the reaction, the reaction product was taken out from the container, cooled and pulverized to obtain a resin composition (A-20). Table 1 shows various physical characteristics.

TABLE 1

| Resin composition A No. | Tg (° C.) | Tm (° C.) | DSC peak temperature (° C.) | DSC peak endothermic quantity (J/g) | $C_{6-30}$ unit amount |
|---|---|---|---|---|---|
| A-1 | 61.1 | 135.4 | 75.2 | 0.29 | 3 |
| A-2 | 56.8 | 129.6 | 75.3 | 1.21 | 3 |
| A-3 | 59.1 | 132.1 | 75.5 | 0.63 | 3 |
| A-4 | 58.9 | 130.2 | 75.1 | 0.65 | 3 |
| A-5 | 59.0 | 130.5 | 75.6 | 0.62 | 3 |
| A-6 | 59.3 | 130.4 | 75.4 | 0.61 | 3 |
| A-7 | 55.1 | 128.4 | 75.4 | 1.57 | 3 |
| A-8 | 63.3 | 137.5 | — | — | 3 |
| A-9 | 60.8 | 135.1 | — | — | 15 |
| A-10 | 63.6 | 137.8 | — | — | 3 |
| A-11 | 63.7 | 137.9 | — | — | — |
| A-12 | 63.9 | 138.2 | — | — | 1 |
| A-13 | 64.2 | 138.1 | — | — | 0.5 |
| A-14 | 60.3 | 134.2 | — | — | 20 |
| A-15 | 59.1 | 133.5 | — | — | 25 |
| A-16 | 64.3 | 138.4 | — | — | — |
| A-17 | 63.1 | 137.4 | — | — | — |
| A-18 | 61.8 | 136.2 | — | — | — |
| A-19 | 61.5 | 136.8 | — | — | — |
| A-20 | 64.1 | 138.3 | — | — | 6 |

In the table, "$C_{6-30}$ unit amount" indicates the total number of moles of the monomer unit represented by the formula (B) and the monomer unit represented by the formula (C) when the total amount of monomer units other than the monomer unit represented by formula (B) among the monomer units derived from the alcohol component in the amorphous polyester segment is 100 mol.

TABLE 2

| Resin composition | Charged composition of polyester resin components (*1) | | | | | | | | | | | | | | | | | |
|---|---|---|---|---|---|---|---|---|---|---|---|---|---|---|---|---|---|---|
| | | | | | | | | | | | | | | | Long-chain alkyl monomer | | CV (*2) | PES/ StAc ratio |
| A No. | BPA-PO | BPA-EO | 1,4-BD | TPA | TRA | DOA | EIA | OCA | TEA | SEA | ADA | SUA | TMA | AA | No. | mass % | St | (*3) |
| A-1 | 70 | 30 | — | 57 | — | — | — | — | — | 3 | — | — | 15 | 10 | W-1 | 2.5 | 100 | 70/30 |
| A-2 | 70 | 30 | — | 57 | — | — | 3 | — | — | — | — | — | 15 | 10 | W-1 | 10.0 | 100 | 70/30 |
| A-3 | 70 | 30 | — | 57 | — | 3 | — | — | — | — | — | — | 15 | 10 | W-1 | 5.0 | 100 | 70/30 |
| A-4 | 70 | 30 | — | 57 | — | — | 3 | — | — | — | — | — | 15 | 10 | W-1 | 5.0 | 100 | 70/30 |

TABLE 2-continued

| Resin composition | Charged composition of polyester resin components (*1) | | | | | | | | | | | | | | | | CV (*2) | PES/ StAc ratio |
|---|---|---|---|---|---|---|---|---|---|---|---|---|---|---|---|---|---|---|
| | | | | | | | | | | | | | | | Long-chain alkyl monomer | | | |
| A No. | BPA-PO | BPA-EO | 1,4-BD | TPA | TRA | DOA | EIA | OCA | TEA | SEA | ADA | SUA | TMA | AA | No. | mass % | St | (*3) |
| A-5 | 70 | 30 | — | 57 | — | — | — | 3 | — | — | — | — | 15 | 10 | W-1 | 5.0 | 100 | 70/30 |
| A-6 | 70 | 30 | — | 57 | — | — | — | — | 3 | — | — | — | 15 | 10 | W-1 | 5.0 | 100 | 70/30 |
| A-7 | 70 | 30 | — | 57 | — | — | — | — | 3 | — | — | — | 15 | 10 | W-1 | 12.5 | 100 | 70/30 |
| A-8 | 70 | 30 | — | 57 | — | — | — | — | 3 | — | — | — | 15 | 10 | — | — | 100 | 70/30 |
| A-9 | 70 | 30 | — | 45 | 15 | — | — | — | — | — | — | — | 15 | 10 | — | — | 100 | 70/30 |
| A-10 | 70 | 30 | — | 57 | — | — | — | — | — | — | 3 | — | 15 | 10 | — | — | 100 | 70/30 |
| A-11 | 70 | 30 | — | 57 | — | — | — | — | — | — | — | 3 | 15 | 10 | — | — | 100 | 70/30 |
| A-12 | 70 | 30 | — | 59 | — | — | — | — | 1 | — | — | — | 15 | 10 | — | — | 100 | 70/30 |
| A-13 | 70 | 30 | — | 60 | — | — | — | — | 0.5 | — | — | — | 15 | 10 | — | — | 100 | 70/30 |
| A-14 | 70 | 30 | — | 40 | — | — | — | — | 20 | — | — | — | 15 | 10 | — | — | 100 | 70/30 |
| A-15 | 70 | 30 | — | 35 | — | — | — | — | 25 | — | — | — | 15 | 10 | — | — | 100 | 70/30 |
| A-16 | 70 | 30 | — | 60 | — | — | — | — | — | — | — | 0.5 | 15 | 10 | — | — | 100 | 70/30 |
| A-17 | 60 | 40 | — | 60 | — | — | — | — | — | — | — | 0.5 | 15 | 10 | — | — | 100 | 70/30 |
| A-18 | 40 | 60 | — | 60 | — | — | — | — | — | — | — | 0.5 | 15 | 10 | — | — | 100 | 70/30 |
| A-19 | 40 | 60 | — | 60 | — | — | — | — | — | — | — | 0.5 | 15 | 10 | — | — | 100 | 60/40 |
| A-20 | 30 | 20 | 50 | 60 | — | — | — | — | — | — | 6 | — | 20 | — | — | — | — | — |

In Table 2, the abbreviations are as follows, and "CV" denotes "composition of vinyl component".

BPA-PO: bisphenol A propylene oxide adduct (2.3 mol adduct)

BPA-EO: bisphenol A ethylene oxide adduct (2.0 mol adduct)

1,4-BD: 1,4-butanediol

TPA: terephthalic acid

TRA: Triacontanedioic acid

DOA: Docosanedioic acid

EIA: Eicosanedioic acid

OCA: Octadecanedioic acid

TEA: Tetradecanedioic acid

SEA: Sebacic acid

ADA: Adipic acid

SUA: Succinic acid

TMA: trimellitic anhydride

AA: Acrylic acid

St: styrene

In the table, the numerical values of monomers other than the long-chain alkyl monomers represent mol parts.

1: The mol part of the monomer indicates the ratio when the total amount of the monomers in the alcohol component (excluding the long-chain alkyl monomer) is 100 mol parts.

2: The mol part of the monomer indicates the ratio when the total amount of the monomers in the vinyl polymer segment is 100 mol parts.

3: The PES/StAc ratio is a polyester segment (excluding long-chain alkyl monomer)/vinyl polymer segment (mass basis) ratio Production Example of Resin Composition (B-1)

| | |
|---|---|
| Bisphenol A ethylene oxide adduct (2.0 mol adduct) | 30.0 mol parts |
| Bisphenol A propylene oxide adduct (2.3 mol adduct) | 20.0 mol parts |
| 1,4-Butanediol | 50.0 mol parts |
| Terephthalic acid | 70.0 mol parts |
| Adipic acid | 4.0 mol parts |
| Trimellitic anhydride | 7.0 mol parts |

The alcohol components and carboxylic acid components (total 8280 g) other than adipic acid and trimellitic anhydride, 45 g of tin (II) 2-ethylhexanoate and 5 g of gallic acid were placed in a 10-liter four-necked flask equipped with a nitrogen introduction tube, a dehydration tube equipped with a distillation tube through which hot water at 100° C. was passed, a stirrer and a thermocouple. After keeping the temperature at 180° C. for 1 h in a nitrogen atmosphere, the temperature was raised from 180° C. to 230° C. at 10° C./h, and then a polycondensation reaction was carried out at 230° C. for 6 h. After reacting at 230° C. at 8.0 kPa for 1 h, adipic acid and trimellitic anhydride were further reacted at 210° C., and the reaction time was adjusted to obtain the desired viscosity at 10 kPa. After completion of the reaction, the reaction product was taken out from the container, cooled and pulverized to obtain a resin composition (B-1). The Tg of the resin composition (B-1) was 52.6° C., and the Tm was 90.2° C.

Production Example of Crystalline Polyester (C-1)

| | |
|---|---|
| Ethylene glycol | 100.0 mol parts |
| Tetradecanedioic acid | 90.0 mol parts |
| Lauric acid | 20.0 mol parts |

A total of 0.2% by mass of dibutyltin oxide based on the above monomers and the total amount of the monomers was placed in a 10 L four-necked flask equipped with a nitrogen introducing tube, a dehydration tube, a stirrer and a thermocouple, and the reaction was performed at 180° C. for 4 hours. Then, the temperature was raised to 210° C. at 10° C./1 hour, the temperature was maintained at 210° C. for 8 hours, and then the reaction was performed at 8.3 kPa for 1 hour to obtain a crystalline polyester (C-1). Table 3 shows the physical properties.

Production Example of Crystalline Polyesters (C-2) to (C-7)

Resin compositions (C-2) to (C-7) were obtained in the same manner as in the Production Example of Crystalline Polyester (C-1) except that the monomer formulation shown in Table 3 was changed. Table 3 shows the physical properties.

TABLE 3

| Crystalline polyester composition No. | Alcohol component Monomer type | Molar part | Acid component Monomer type | Molar part | Terminal monomer Monomer type | Molar part | DSC peak temperature (° C.) |
|---|---|---|---|---|---|---|---|
| C-1 | Ethylene glycol | 100.0 | Tetradecanedioic acid | 90.0 | Lauric acid | 20.0 | 88 |
| C-2 | 1,4-Butane diol | 100.0 | Dodecanedioic acid | 90.0 | Lauric acid | 20.0 | 70 |
| C-3 | 1,6-Hexane diol | 100.0 | Sebacic acid | 90.0 | Lauric acid | 20.0 | 72 |
| C-4 | 1,4-Butane diol | 100.0 | Adipic acid | 90.0 | Lauric acid | 20.0 | 68 |
| C-5 | Ethylene glycol | 100.0 | Adipic acid | 90.0 | Lauric acid | 20.0 | 72 |
| C-6 | 1,6-Hexane diol | 100.0 | Dodecanedioic acid | 90.0 | Lauric acid | 20.0 | 71 |
| C-7 | 1,6-Hexane diol | 100.0 | Dodecanedioic acid | 95.0 | Stearic acid | 10.0 | 70 |

Production Example of Magnetic Particle 1

(1) Production of Core Particles

A total of 92 L of a ferrous sulfate aqueous solution having a $Fe^{2+}$ concentration of 1.60 mol/L and 88 L of a 3.50 mol/L sodium hydroxide aqueous solution were added and mixed and stirred. The pH of this solution was 6.5. While maintaining this solution at a temperature of 89° C. and a pH of from 9 to 12, 20 L/min of air was blown in to cause an oxidation reaction and generate core particles. When the ferrous hydroxide was completely consumed, the blowing of air was stopped and the oxidation reaction was terminated. The obtained core particles made of magnetite had an octahedral shape.

(2) Formation of Coating Layer

After mixing 2.50 L of a 0.7 mol/L sodium silicate aqueous solution and 2.00 L of a 0.90 mol/L ferrous sulfate aqueous solution, 1.00 L of water was added to make 5.00 L of an aqueous solution that was added to the slurry after the reaction that included 13,500 g of core particles while maintaining pH at 7 to 9. Then, air was blown at 10 L/min until $Fe^{2+}$ in the slurry did not remain.

Subsequently, 0.70 L of a 1.50 mol/L aluminum sulfate aqueous solution and 2.00 L of a 0.90 mol/L ferrous sulfate aqueous solution were mixed, and then 1.00 L of water was added to make 5.00 L of an aqueous solution that was added to the slurry after the reaction that included core particles while maintaining pH at 7 to 9. Then, air was blown at 10 L/min until $Fe^{2+}$ in the slurry did not remain. The temperature of the slurry was maintained at 89° C. After mixing and stirring for 30 minutes, the slurry was filtered, washed and dried to obtain magnetic particles 1.

The shape of the magnetic particle 1 was octahedron, and the number average particle diameter (D1) of the primary particles was 110 nm. Table 4 shows various physical characteristics thereof.

TABLE 4

| Magnetic particle | Number average particle diameter of primary particles nm | Shape — | ESCA analysis results Si | Al | Fe |
|---|---|---|---|---|---|
| Magnetic particle 1 | 110 | Octahedron | 5.21 | 2.15 | 12.97 |

In the table, the elemental amount by ESCA indicates atomic %.

Release Agent 1 and 2

The release agents shown in Table 5 were used.

TABLE 5

| Release agent No. | Product name | Melting point |
|---|---|---|
| Release agent 1 | C105 (Sasol Co., Ltd.) | 105° C. |
| Release agent 2 | NP-105 (Mitsui Chemicals, Inc.) | 140° C. |

Example 1

| | |
|---|---|
| Polyester resin composition (A-1) | 100.0 parts |
| Crystalline polyester (C-1) | 12.0 parts |
| Magnetic particles 1 | 50.0 parts |
| Release agent 1 | 2.0 parts |
| Charge control agent (T-77, manufactured by Hodogaya Chemical Co., Ltd.) | 1.0 part |

The above materials were premixed with a Henschel mixer and then melt-kneaded at a set temperature of 120° C. by using a twin-screw kneading extruder (PCM-30 type manufactured by Ikegai Iron Works Co., Ltd.). After that, the coarsely pulverized product was pulverized with a mechanical pulverizer (T-250 manufactured by Turbo Industries, Ltd.), and the obtained finely pulverized powder was classified using a multi-division classifier utilizing the Coanda effect to obtain negatively chargeable toner particles 1 having a weight average particle diameter (D4) of 7.0 μm.

First-Stage External Addition Step

A total of 1.0 part of ATLAS 100 (manufactured by CABOT Corp.) per 100.0 parts of toner particles 1 was loaded in a Henschel mixer (FM500L/I-H type manufactured by Nippon Coke Industries Co., Ltd.) in which the processing blades were changed to a rotating body shown in FIGS. 1A and 1B, and mixing was performed at 800 rpm for 15 min. At this time, hot water at 55° C. was passed through the jacket at the same time as the start of mixing. When the temperature inside the tank reached 50° C., cold water at 7° C. was passed through, and at the same time, the temperature inside the tank was maintained at 50° C. by controlling the flow rate of the cold water. After the mixing was completed, the first-stage externally-added toner 1 was immediately discharged and cooled to room temperature.

Second-Stage External Addition Step

Next, 1.0 part of hydrophobic silica fine particles 1 [BET specific surface area 150 $m^2/g$, hydrophobicized with 30 parts of hexamethyldisilazane (HMDS) and 10 parts of dimethyl silicon oil per 100 parts of silica fine particles] per 100 parts of the first-stage externally-added toner 1 were externally mixed with a Henshell mixer (FM-75 type manufactured by Nippon Coke Industries Co., Ltd.) for 5 min, and the mixture was sieved with a mesh having an opening of 150 μm to obtain a toner (T-1). Table 6 shows various physical characteristics of the obtained toner (T-1).

The following evaluation was performed using the obtained toner.

Test

The HP LaserJet Enterprise M609dn was used with the process speed modified to 500 mm/sec in consideration of further speeding up of the printer in the future. Table 7 shows the results of the evaluation.

Low-Temperature Fixability; Rubbing Density Reduction Rate

For the rubbing density reduction rate, an external fixing unit obtained by taking out and modifying the fixing unit of the evaluation apparatus to enable arbitrary setting of the fixing unit temperature and to obtain a process speed of 500 mm/sec was used. Using the above device, an unfixed image in which the toner laid-on level per unit area was set to 0.5 mg/cm$^2$ was passed in a normal temperature and humidity environment (temperature 25° C., humidity 50% RH) through the fixing unit adjusted to 180° C. As the evaluation paper, "PB PAPER" (manufactured by Canon Marketing Japan Inc., basis weight 66 g/cm$^2$, letter) was used. The obtained fixed image was rubbed with Sylbon paper to which a load of 4.9 kPa (50 g/cm$^2$) was applied, and evaluated by a reduction rate (%) of the image density before and after the rubbing. A and B ranks were considered acceptable.

A: The rate of decrease in image density is less than 10%.
B: The rate of decrease in image density is 10% or more and less than 15%.
C: The rate of decrease in image density is 15% or more and less than 20%.
D: The rate of decrease in image density is 20% or more.

Image Streaks

After emptying the toner in the cartridge, 700 g of toner (T-1) was filled. A horizontal line pattern with a print percentage of 1.5% was set as 2 sheets/job, and a printing test of 35,000 images was conducted in a mode which was set so that the machine was temporarily stopped between jobs and then the next job was started. The evaluation was performed in a high temperature and high humidity environment (temperature 32.5° C., humidity 85% RH). The evaluation paper used was PB PAPER (manufactured by Canon Marketing Japan Inc., basis weight 66 g/cm$^2$, letter). As a check image, a halftone image (dot print percentage 23%) of 200 mm×280 mm was outputted, it was visually observed whether vertical streaks were generated in the check image, and evaluation was performed based on the following criteria. A and B ranks were considered acceptable.

A: From 0 to 3 streaks of less than 1 mm are generated, and no streaks of 1 mm or more are generated.
B: From 4 to 7 streaks of less than 1 mm are generated, and no streaks of 1 mm or more are generated.
C: 8 or more streaks of less than 1 mm are generated, and no streaks of 1 mm or more are generated.
D: A streak of 1 mm or more is generated.

Evaluation of Fogging

After emptying the toner in the cartridge, 700 g of toner (T-1) was filled. A horizontal line pattern with a print percentage of 1.5% was set as 2 sheets/job, and a printing test of 35,000 images was conducted in a mode which was set so that the machine was temporarily stopped between jobs and then the next job was started. The evaluation was performed in a low temperature and low humidity environment (temperature 10° C., humidity 20% RH). The evaluation paper used was PB PAPER (manufactured by Canon Marketing Japan Inc., basis weight 66 g/cm$^2$, letter). As a check image, one image with a full-surface white background was outputted.

After that, for the outputted image with a full-surface white background, $$\text{Fogging concentration (\%)} \ (=Dr(\%)-Ds(\%))$$

was calculated from the difference between the whiteness of the white background (reflectance Ds (%)) and the whiteness of the transfer paper (average reflectance Dr (%)). The whiteness was measured by "REFLECTMETER MODEL TC-6DS" (manufactured by Tokyo Denshoku Co., Ltd.). As the filter, an amber light filter was used. The ones with the lowest fog concentration were ranked as follows. Ranks A to C were considered acceptable.

A: The fogging concentration is less than 2.5%.
B: The fogging concentration is 2.5% or more and less than 4.0%.
C: The fogging concentration is 4.0% or more and less than 5.5%.
D: The fogging concentration is 5.5% or more.

Evaluation of Initial Image Density (Initial Developing Performance)

Evaluation was performed using the above modified machine. After emptying the toner in the cartridge, 400 g of toner (T-1) was filled. In a high-temperature and high-humidity environment (temperature 32° C., relative humidity 80%), the operation of outputting an image having a print percentage of 1% was repeated, and each time the number of output sheets reached 499, the image was left overnight. After that, a check image having solid black patch images of 5 mm×5 mm at three places on the left, right, and center and further 3 places at intervals of 30 mm in the longitudinal direction, for a total of 9 places, in the 500th sheet with a tip margin of 5 mm and a left and right margin of 5 mm was outputted.

The process of outputting 499 images as described above, allowing to stand overnight, and then outputting the check image was repeated, and finally 5000 images were outputted, and the evaluation was performed by the following method. As the evaluation paper, "PB PAPER" (manufactured by Canon Marketing Japan Inc., basis weight 66 g/cm$^2$, letter) was used. The image densities of the solid black patch image portions at 9 locations of all the check images were measured, and the average value was calculated. The image density was measured with a Macbeth densitometer (manufactured by Macbeth), which is a reflection densitometer, using an SPI filter, and was evaluated according to the following criteria. Ranks A to C were considered acceptable.

A: 1.40 or more
B: 1.30 or more and less than 1.40
C: 1.20 or more and less than 1.30
D: less than 1.20

Image Density after Durability Testing

The evaluation was performed using the modified machine described above. The toner in the cartridge was emptied out and the cartridge was then filled with 700 g of toner (T-1).

A test was run in which 35,000 prints were output, using 2 prints/1 job of a horizontal line pattern having a print percentage of 1.5%, in a mode in which the machine was set to temporarily stop between jobs and then start the next job. The evaluation was performed in a high-temperature, high-humidity environment (temperature=32.5° C., humidity=85% RH). PB PAPER (Canon Marketing Japan Inc., areal weight=66 g/cm$^2$, letter) was used for the evaluation paper.

At 35,001st print, a check image was output having a total of nine 5 mm×5 mm solid black patch images, at 3 locations, i.e., left, right, and center, with a 5 mm leading edge margin and 5 mm right and left margins, and these at 3 locations on a 30-mm interval in the length direction.

The image density was measured at the nine solid black patch image regions of the check image and the average value was determined. The image density was measured with a MacBeth densitometer (GretagMacbeth GmbH), which is a reflection densitometer, using an SPI filter, and the evaluation was made using the following criteria. Ranks A to C were considered to be satisfactory.

A: The mage density is 1.30 or higher.
B: The image density is from 1.10 to less than 1.30.
C: The image density is from 0.90 to less than 1.10.
D: The image density is less than 0.90.

Examples 2 to 21, Comparative Example 2

Toners (T-2) to (T-21) and (T-26) were obtained in the same manner as in Example 1 except that the formulations shown in Table 7 were used. Table 6 shows various physical characteristics. Table 8 shows the results of evaluation in the same manner as in Example 1.

Example 22

Toner (T-22) was obtained in the same manner as in Example 1 except that the formulation was changed to that shown in Table 7 and the blade rotation speed in the first-stage external addition step was changed to 600 rpm. Table 6 shows various physical characteristics. Table 8 shows the results of evaluation in the same manner as in Example 1.

Examples 23 to 25, Comparative Example 1

Toners (T-23) to (T-25) were obtained in the same manner as in Example 1 except that the formulations shown in Table 7 were changed and the toner production method was changed to the following conditions. Table 6 shows various physical characteristics. Table 8 shows the results of evaluation in the same manner as in Example 1.

The materials shown in Table 7 were premixed with a Henschel mixer and then melt-kneaded at a set temperature of 120° C. by a twin-screw kneading extruder (PCM-30 type manufactured by Ikegai Iron Works Co., Ltd.). The obtained kneaded product was cooled, coarsely pulverized with a hammer mill, and then annealed for 1 day in an environment of a temperature of 50° C. and a relative humidity of 95%. After that, the coarsely pulverized material was pulverized with a mechanical pulverizer (T-250 manufactured by Turbo Industries, Ltd.), and the obtained finely pulverized powder was classified using a multi-division classifier utilizing the Coanda effect, and weight averaged. Negatively chargeable toner particles 23 to 25 having a weight average particle diameter (D4) of 7.0 μm were obtained.

First-Stage External Addition Step

A total of 1.0 part of ATLAS 100 per 100.0 parts of toner particles 23 to 25 respectively was loaded in a Henschel mixer (FM500L/I-H type manufactured by Nippon Coke Industries Co., Ltd.) in which the processing blade was changed to the rotating body shown in FIGS. 1A and 1B, and mixing was performed at 600 rpm for 15 min. At this time, hot water at 55° C. was passed through the jacket at the same time as the start of mixing. When the temperature inside the tank reached 50° C., cold water at 7° C. was passed through, and at the same time, the temperature inside the tank was maintained at 50° C. by controlling the flow rate of the cold water. After the mixing was completed, the first-stage externally added toners 23 to 25 were immediately discharged and cooled to room temperature.

Second-Stage External Attachment Process

Next, 1.0 part of hydrophobic silica fine particles 1 [BET specific surface area 150 m$^2$/g, hydrophobicized with 30 parts of hexamethyldisilazane (HMDS) and 10 parts of dimethyl silicone oil per 100 parts of silica fine particles] per 100 parts of each of the first-stage external toners 23 to 25 was externally added and mixed for 5 min in a Henshell mixer (FM-75 type manufactured by Nippon Coke Industries Co., Ltd.), and the mixture was sieved with a mesh with an opening of 150 μm to obtain toners (T-23) to (T-25).

Comparative Example 3

Toner (T-27) was obtained in the same manner as in Example 1 except that the formulation was changed to that shown in Table 7 and the first-stage external addition step was changed to the following conditions. Table 6 shows various physical characteristics. Table 8 shows the results of evaluation in the same manner as in Example 1.

First-Stage External Addition Step

A total of 1.0 part of ATLAS 100 per 100.0 parts of toner particles 27 was loaded in a Henschel mixer (FM500L/I-H type manufactured by Nippon Coke Industries Co., Ltd.) equipped with the usual blades, and mixing was performed at 800 rpm for 10 min. At this time, cold water at 7° C. was passed through the jacket at the same time as the start of mixing. After the mixing was completed, the first-stage externally added toner 27 were immediately discharged and cooled to room temperature.

TABLE 6

| Toner | MDSC measurement: Endothermic peak temperature derived from crystalline resin (° C.) | Ratio of endothermic quantity (%) | Tg1st (° C.) | Tg2nd (° C.) | Tg1st − Tg2nd (° C.) |
|---|---|---|---|---|---|
| Toner 1 | 82.1 | 86.8 | 60.1 | 44.6 | 15.5 |
| Toner 2 | 82.3 | 85.9 | 56.4 | 41.3 | 15.1 |
| Toner 3 | 82.1 | 80.2 | 58.2 | 42.9 | 15.3 |
| Toner 4 | 65.4 | 76.0 | 58.1 | 43.0 | 15.1 |
| Toner 5 | 66.8 | 70.8 | 57.9 | 42.9 | 15.0 |
| Toner 6 | 63.1 | 70.6 | 58.4 | 43.1 | 15.3 |
| Toner 7 | 66.8 | 70.1 | 58.7 | 43.2 | 15.5 |
| Toner 8 | 66.4 | 80.6 | 58.1 | 47.0 | 11.1 |
| Toner 9 | 66.9 | 80.1 | 54.2 | 43.3 | 10.9 |
| Toner 10 | 66.7 | 65.2 | 62.1 | 46.6 | 15.5 |
| Toner 11 | 66.5 | 65.9 | 59.1 | 43.2 | 15.9 |
| Toner 12 | 66.4 | 66.1 | 62.1 | 46.8 | 15.3 |
| Toner 13 | 66.8 | 60.8 | 61.9 | 46.5 | 15.4 |
| Toner 14 | 66.8 | 61.1 | 62.7 | 47.2 | 15.5 |

TABLE 6-continued

| Toner | MDSC measurement: Endothermic peak temperature derived from crystalline resin (° C.) | Ratio of endothermic quantity (%) | Tg1st (° C.) | Tg2nd (° C.) | Tg1st − Tg2nd (° C.) |
|---|---|---|---|---|---|
| Toner 15 | 66.4 | 55.4 | 62.8 | 47.7 | 15.1 |
| Toner 16 | 66.7 | 66.1 | 59.1 | 43.1 | 16.0 |
| Toner 17 | 66.6 | 65.8 | 58.8 | 43.0 | 15.8 |
| Toner 18 | 66.8 | 50.8 | 63.1 | 47.5 | 15.6 |
| Toner 19 | 66.7 | 55.4 | 62.4 | 49.7 | 12.7 |
| Toner 20 | 66.8 | 60.7 | 61.4 | 51.2 | 10.2 |
| Toner 21 | 66.6 | 60.1 | 60.8 | 53.3 | 7.5 |
| Toner 22 | 66.8 | 51.1 | 57.1 | 49.3 | 7.8 |
| Toner 23 | 66.7 | 50.1 | 58.1 | 42.3 | 15.8 |
| Toner 24 | 82.4 | 50.3 | 63.3 | 48.2 | 15.1 |
| Toner 25 | 66.8 | 41.1 | 60.8 | 53.2 | 7.6 |
| Toner 26 | 65.9 | 50.1 | 61.1 | 56.2 | 4.9 |
| Toner 27 | 64.8 | 37.1 | 52.8 | 44.4 | 8.4 |

TABLE 7

| Toner | Resin composition A | | Resin composition B | | Crystalline polyester C | | Magnetic particles | | Release agent | | |
|---|---|---|---|---|---|---|---|---|---|---|---|
| No. | NO. | parts | NO. | parts | NO. | parts | NO. | parts | NO. | parts | \|C3-C4\| |
| 1 | A-1 | 100 | — | | C-1 | 12 | Magnetic particles 1 | 50 | Release agent 1 | 2 | 4 |
| 2 | A-2 | 100 | — | | C-1 | 12 | Magnetic particles 1 | 50 | Release agent 1 | 2 | 6 |
| 3 | A-3 | 100 | — | | C-1 | 12 | Magnetic particles 1 | 50 | Release agent 1 | 2 | 8 |
| 4 | A-4 | 100 | — | | C-2 | 12 | Magnetic particles 1 | 50 | Release agent 1 | 2 | 8 |
| 5 | A-5 | 100 | — | | C-3 | 12 | Magnetic particles 1 | 50 | Release agent 1 | 2 | 8 |
| 6 | A-6 | 100 | — | | C-4 | 12 | Magnetic particles 1 | 50 | Release agent 1 | 2 | 8 |
| 7 | A-6 | 100 | — | | C-5 | 12 | Magnetic particles 1 | 50 | Release agent 1 | 2 | 8 |
| 8 | A-4 | 100 | — | | C-6 | 12 | Magnetic particles 1 | 50 | Release agent 1 | 2 | 8 |
| 9 | A-7 | 100 | — | | C-5 | 12 | Magnetic particles 1 | 50 | Release agent 1 | 2 | 8 |
| 10 | A-8 | 100 | — | | C-5 | 12 | Magnetic particles 1 | 50 | Release agent 1 | 2 | 8 |
| 11 | A-9 | 100 | — | | C-5 | 12 | Magnetic particles 1 | 50 | Release agent 1 | 2 | 24 |
| 12 | A-10 | 100 | — | | C-5 | 12 | Magnetic particles 1 | 50 | Release agent 1 | 2 | 0 |
| 13 | A-11 | 100 | — | | C-5 | 12 | Magnetic particles 1 | 50 | Release agent 1 | 2 | 2 |
| 14 | A-12 | 100 | — | | C-5 | 12 | Magnetic particles 1 | 50 | Release agent 1 | 2 | 8 |
| 15 | A-13 | 100 | — | | C-5 | 12 | Magnetic particles 1 | 50 | Release agent 1 | 2 | 8 |
| 16 | A-14 | 100 | — | | C-5 | 12 | Magnetic particles 1 | 50 | Release agent 1 | 2 | 8 |
| 17 | A-15 | 100 | — | | C-5 | 12 | Magnetic particles 1 | 50 | Release agent 1 | 2 | 8 |
| 18 | A-16 | 100 | — | | C-5 | 12 | Magnetic particles 1 | 50 | Release agent 1 | 2 | 2 |
| 19 | A-17 | 100 | — | | C-5 | 12 | Magnetic particles 1 | 50 | Release agent 1 | 2 | 2 |
| 20 | A-18 | 100 | — | | C-5 | 12 | Magnetic particles 1 | 50 | Release agent 1 | 2 | 2 |
| 21 | A-19 | 100 | — | | C-5 | 12 | Magnetic particles 1 | 50 | Release agent 1 | 2 | 2 |
| 22 | A-19 | 100 | — | | C-5 | 12 | Magnetic particles 1 | 50 | Release agent 1 | 2 | 2 |
| 23 | A-6 | 100 | — | | C-5 | 12 | Magnetic particles 1 | 50 | Release agent 1 | 2 | 8 |
| 24 | A-13 | 100 | — | | C-1 | 12 | Magnetic particles 1 | 50 | Release agent 1 | 2 | 0 |
| 25 | A-19 | 100 | — | | C-5 | 12 | Magnetic particles 1 | 50 | Release agent 1 | 2 | 2 |
| 26 | A-19 | 100 | — | | C-6 | 12 | Magnetic particles 1 | 50 | Release agent 1 | 2 | 8 |
| 27 | A-20 | 60 | B-1 | 30 | C-7 | 10 | Magnetic particles 1 | 50 | Release agent 2 | 2 | 6 |

TABLE 8

| Example | Toner No. | Rubbing density reduction ratio (%) | Image streaks | Fogging | Initial image density | Image density after durability |
|---|---|---|---|---|---|---|
| Example 1 | 1 | A(3) | A(0) | A(2.3) | A(1.45) | A(1.40) |
| Example 2 | 2 | A(3) | A(0) | A(2.4) | A(1.45) | A(1.40) |
| Example 3 | 3 | A(3) | A(1) | B(3.0) | A(1.44) | A(1.39) |
| Example 4 | 4 | A(4) | A(2) | B(3.0) | A(1.45) | A(1.32) |
| Example 5 | 5 | A(4) | A(3) | B(3.1) | A(1.45) | B(1.25) |
| Example 6 | 6 | A(3) | A(3) | B(3.1) | A(1.44) | B(1.25) |
| Example 7 | 7 | A(3) | A(3) | B(3.0) | A(1.45) | B(1.24) |
| Example 8 | 8 | B (10) | A(1) | B(3.0) | A(1.45) | B(1.25) |
| Example 9 | 9 | B (10) | A(1) | B(3.1) | A(1.44) | B(1.17) |

TABLE 8-continued

| Example | Toner No. | Rubbing density reduction ratio (%) | Image streaks | Fogging | Initial image density | Image density after durability |
|---|---|---|---|---|---|---|
| Example 10 | 10 | A(3) | B (4) | B(3.0) | A(1.45) | B(1.18) |
| Example 11 | 11 | A(3) | B (4) | B(3.0) | A(1.45) | B(1.18) |
| Example 12 | 12 | A(3) | B (4) | B(3.0) | A(1.45) | B(1.17) |
| Example 13 | 13 | A(4) | B (5) | B(3.6) | A(1.44) | B(1.18) |
| Example 14 | 14 | A(3) | B (5) | B(3.6) | A(1.45) | B(1.18) |
| Example 15 | 15 | A(3) | B (6) | C(4.2) | A(1.45) | B(1.17) |
| Example 16 | 16 | A(3) | B (4) | B(3.0) | A(1.44) | B(1.11) |
| Example 17 | 17 | A(4) | B (4) | B(3.1) | A(1.44) | C(1.05) |
| Example 18 | 18 | A(3) | B (7) | C(4.8) | A(1.45) | B(1.17) |
| Example 19 | 19 | A(7) | B (6) | C(4.8) | B(1.35) | B(1.18) |
| Example 20 | 20 | B (10) | B (5) | C(4.7) | C(1.25) | B(1.18) |
| Example 21 | 21 | B (14) | B (5) | C(5.4) | C(1.25) | B(1.17) |
| Example 22 | 22 | B (14) | B (7) | C(5.4) | C(1.25) | B(1.18) |
| Example 23 | 23 | A(3) | B (7) | B(3.0) | A(1.44) | B(1.25) |
| Example 24 | 24 | A(3) | B (7) | B(3.6) | A(1.45) | A(1.32) |
| Comparative Example 1 | 25 | B (14) | D (Two of 1 mm or more) | C(5.4) | C(1.25) | C(1.04) |
| Comparative Example 2 | 26 | D(22) | B (7) | D(6.1) | C(1.25) | B(1.11) |
| Comparative Example 3 | 27 | B (12) | D (Three of 1 mm or more) | D(5.8) | D(1.18) | D(0.87) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2020-086600, filed May 18, 2020, which is hereby incorporated by reference herein in its entirety.

What is claimed is:

1. A toner, comprising:

a toner particle comprising a binder resin and a crystalline polyester resin;

the binder resin comprises an amorphous polyester resin comprising a hybrid resin having a vinyl polymer segment and an amorphous polyester segment;

the amorphous polyester segment comprising at least one monomer unit selected from the group consisting of formulae (B) and (C)

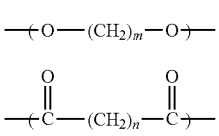

(B)

(C)

where m represents an integer of 6 to 30, and n represents an integer of 4 to 28;

a total amount of monomer units represented by formulae (B) and (C) is 1 to 20 mol parts when a total of monomer units other than the monomer unit represented by formula (B) among monomer units derived from an alcohol component in the amorphous polyester segment is 100 mol parts, wherein when the toner is measured with a temperature-modulated differential scanning calorimeter, (i) at least one endothermic peak derived from the crystalline polyester resin is present in a temperature range of 55.0 to 95.0° C. in a total heat flow, (ii) a ratio of an endothermic quantity of the endothermic peak in a reversing heat flow to an endothermic quantity of the endothermic peak in the total heat flow is 50.0% or more, and (iii) Tg1st−Tg2nd≥7.0° C. where Tg1st is a glass transition temperature obtained in the reversing heat flow in a first temperature rise and Tg2nd is a glass transition temperature obtained in a reversing heat flow in a second temperature rise.

2. The toner according to claim 1, wherein an amount of the amorphous polyester segment in the hybrid resin is 60 to 98% by mass.

3. The toner according to claim 1, wherein the amorphous polyester segment comprises a structure in which at least one alcohol component selected from the group consisting of bisphenol A propylene oxide adduct and bisphenol A ethylene oxide adduct, and an acid component are polycondensed, and a molar ratio of a monomer unit derived from the bisphenol A propylene oxide adduct to a monomer unit derived from the bisphenol A ethylene oxide adduct is from 50:50 to 100:0.

4. The toner according to claim 1, wherein the crystalline polyester resin is a polycondesate of an alcohol component comprising an aliphatic diol and an acid component comprising an aliphatic dicarboxylic acid, and

|C3−C4| is 0 to 6 when C3 is the number of carbon atoms of a monomer unit having the largest number of carbon atoms among the monomer units represented by formulae (B) and (C) in the amorphous polyester segment, and C4 is the number of carbon atoms in a component having the largest number of carbon atoms among the aliphatic diol and the aliphatic dicarboxylic acid compound constituting the crystalline polyester resin.

5. The toner according to claim 1, wherein the amorphous polyester resin is an amorphous polyester resin composition comprising the hybrid resin, the amorphous polyester resin composition comprises at least one of a structure in which a long-chain alkyl monoalcohol having an average number of carbon atoms of 27 to 50 is condensed at an end of the amorphous polyester segment, and a structure in which a long-chain alkyl monocarboxylic acid having an average number of carbon atoms of 27 to 50 is condensed at an end of the amorphous polyester segment, and an aliphatic hydrocarbon having an average number of carbon atoms of 27 to 50, and a total content ratio of the aliphatic hydrocarbon, the structure in which the long-chain alkyl monoalcohol is condensed, and the structure in which the long-chain alkyl monocarboxylic acid is condensed in the amorphous polyester resin composition is 2.5 to 10% by mass.

6. The toner according to claim 1, wherein the crystalline polyester resin is a polycondensate of an alcohol component including an aliphatic diol, and an acid component including an aliphatic dicarboxylic acid, and $8 \leq C1+C2 \leq 16$ when C1 is the number of carbon atoms in the aliphatic diol and C2 is the number of carbon atoms in the aliphatic dicarboxylic acid.

7. The toner according to claim 6, wherein $2 \leq C1 \leq 4$ or $2 \leq C2 \leq 4$.

8. The toner according to claim 1, wherein the ratio of the endothermic quantity of the endothermic peak in the reversing heat flow to the endothermic quantity of the endothermic peak in the total heat flow is 70.0 to 95.0%.

9. The toner according to claim 1, wherein the Tg1st−Tg2nd is 10.0 to to 25.0° C.

* * * * *